US008265525B2

(12) United States Patent
Wada

(10) Patent No.: US 8,265,525 B2
(45) Date of Patent: Sep. 11, 2012

(54) ELECTROCONDUCTIVE ROLL, CHARGING DEVICE, PROCESS CARTRIDGE, AND IMAGE FORMING APPARATUS

(75) Inventor: Noboru Wada, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 346 days.

(21) Appl. No.: 12/695,637

(22) Filed: Jan. 28, 2010

(65) Prior Publication Data

US 2011/0002711 A1 Jan. 6, 2011

(30) Foreign Application Priority Data

Jul. 2, 2009 (JP) ..... 2009-158083

(51) Int. Cl.
*G03G 15/02* (2006.01)

(52) U.S. Cl. ..... 399/176; 399/279

(58) Field of Classification Search ..... 399/176, 399/279, 286; 492/56, 59
See application file for complete search history.

(56) References Cited

U.S. PATENT DOCUMENTS 6,115,575 A * 9/2000 Kinoshita et al. ..... 399/286
7,288,058 B2 * 10/2007 Kaji et al. ..... 492/59
7,364,791 B2 * 4/2008 Shimamura et al. ..... 428/323
7,526,239 B2 * 4/2009 Kawano et al. ..... 399/286
7,672,633 B2 * 3/2010 Kondoh ..... 399/333
2004/0152575 A1 * 8/2004 Kaji et al. ..... 492/56
2008/0292366 A1 * 11/2008 Akama et al. ..... 399/286

FOREIGN PATENT DOCUMENTS

JP A 9-258523 10/1997

* cited by examiner

*Primary Examiner* — David Gray
*Assistant Examiner* — G. M. Hyder
(74) *Attorney, Agent, or Firm* — Oliff & Berridge, PLC

(57) ABSTRACT

The invention provides an electroconductive roll having at least a surface layer forming an outer peripheral surface of the electroconductive roll. The surface layer contains projections and recesses. The projections contain a plurality of particles. A ratio of an area occupied by particles existing in a cross-section of a projection to an entire area of the cross-section of the projection is larger than a ratio of an area occupied by particles existing in a cross-section of a recess to an entire area of the cross-section of the recess. The invention further provides a process cartridge having a charging roll which is the electroconductive roll and/or a transfer roll which is the electroconductive roll. The invention further provides an image forming apparatus having a charging unit containing the electroconductive roll and/or a transfer unit containing the electroconductive roll.

17 Claims, 6 Drawing Sheets

ELECTROCONDUCTIVE ROLL, CHARGING DEVICE, PROCESS CARTRIDGE, AND IMAGE FORMING APPARATUS

CROSS-REFERENCE TO RELATED APPLICATIONS

This application claims priority under 35 USC 119 from Japanese Patent Application No. 2009-158083 filed on Jul. 2, 2009.

BACKGROUND

1. Technical Field

The invention relates to an electroconductive roll, a charging device, a process cartridge, and an image forming apparatus.

2. Related Art

In the image forming apparatus using an electrophotographic system, after an image holding body is charged by a charging roll and a latent image is formed by irradiating the charged image holding body with laser beam or the like, the latent image is developed with toner to form a visualized toner image. Thereafter, the obtained toner image is transferred to a transfer member. Examples of the transfer member include an intermediate transfer body and a recording medium. When the image forming apparatus has an intermediate transfer body, the toner image held on an image holding body is transferred to the intermediate transfer body by a primary transfer roll, and then the toner image is transferred to a recording medium by using a secondary transfer roll or a backup roll. When the image forming apparatus has no intermediate transfer body, a toner image formed on an image holding body is transferred to a recording medium by using a transfer roll. The toner image transferred to the recording medium is fixed by a fixing device, thereby forming an image on a recording medium.

In the image forming apparatus, electroconductive rolls such as the charging roll or transfer rolls such as the primary transfer roll, the secondary transfer roll or the backup roll are in a state of being respectively in contact with an exterior member, at which an electric field is formed, and charge the exterior member or transfer toner image. Herein, the "exterior member" for the charging roll is an image holding body, and that for the transfer roll is the image holding body or an intermediate transfer body.

The electroconductive rolls are used in a state of being respectively in contact with exterior members such as an image holding body or an intermediate transfer body. Therefore, it is preferable that the surface of the electroconductive rolls are not deteriorated even when being used over a long period of time.

SUMMARY

An exemplary embodiment of one aspect of the present invention is (1) an electroconductive roll having at least a surface layer forming an outer peripheral surface of the electroconductive roll, the surface layer comprising projections and recesses, the projections comprising a plurality of particles, and a ratio of an area occupied by particles existing in a cross-section of a projection to an entire area of the cross-section of the projection being larger than a ratio of an area occupied by particles existing in a cross-section of a recess to an entire area of the cross-section of the recess.

BRIEF DESCRIPTION OF THE DRAWINGS

Exemplary embodiments of the present invention are described in detail on the following figures, wherein.

DETAILED DESCRIPTION

Conductive Roll

An exemplary embodiment of one aspect of the invention is an electroconductive roll having at least a surface layer forming an outer peripheral surface of the electroconductive roll, the surface layer having at least projections and recesses, the projections containing at least a plurality of particles, and a ratio of an area occupied by particles existing in a cross-section of a projection to an entire area of the cross-section of the projection being larger than a ratio of an area occupied by particles existing in a cross-section of a recess to an entire area of the cross-section of the recess.

In the present exemplary embodiment, expressions like "one object is electroconductive" or "one object has electroconductivity" mean that the volume resistivity of the object is less than about $10^{13}$ Ωcm. The measuring method of the electroconductivity is described below.

Figure 2:
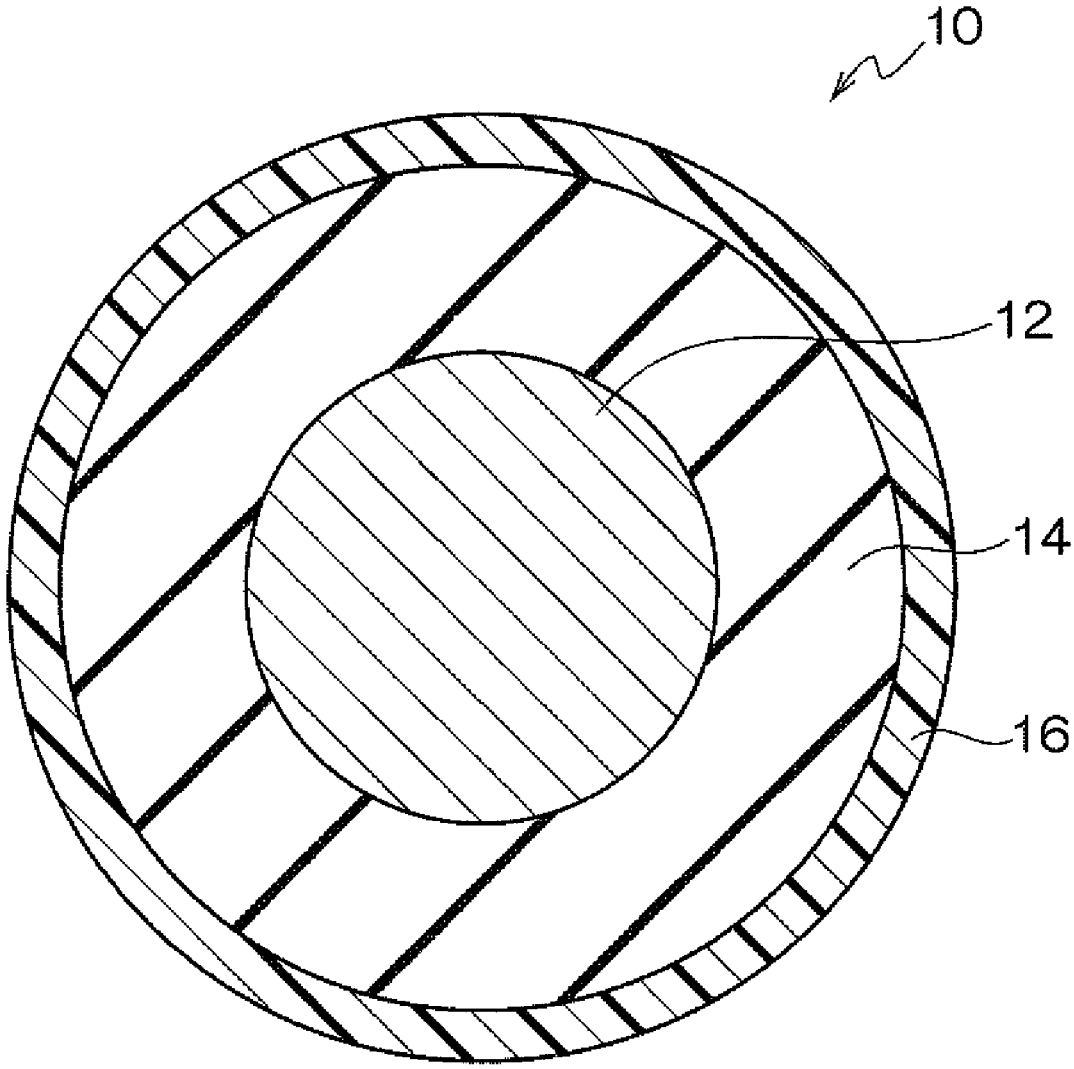
FIG. 2 is a schematic drawing of an electroconductive roll according to an exemplary embodiment.

As shown in FIG. 2, the electroconductive roll 10 of the present exemplary embodiment is formed by sequentially providing, on the outer peripheral surface of a cylindrical core body 12, an elastic layer 14 and a surface layer 16 in this order.

The electroconductive roll 10 corresponds to the electroconductive roll of an exemplary embodiment of one aspect of the invention. The outer surface of the surface layer 16 corresponds to the outer peripheral surface, that is the outer surface of the surface layer, of the electroconductive roll of the exemplary embodiment. The core body 12 corresponds to the core body of the electroconductive roll of the exemplary embodiment. The elastic layer 14 corresponds to the elastic layer of the electroconductive roll of the exemplary embodiment. The surface layer 16 corresponds to the surface layer of the electroconductive roll of the exemplary embodiment. Particles 16B correspond to plural particles existing in the projections of the electroconductive roll of the exemplary embodiment. The resin material 16A corresponds to the resin material of the electroconductive roll of the exemplary embodiment.

Core Body

The core body 12 is a cylindrical member which serves as an electrode and a supporting member of the electroconductive roll 10, and is formed of a conductive material. Examples of the conductive material include: a metal or alloy such as free cutting steel, aluminum, copper alloy, or stainless steel; iron plated with chromium, nickel or the like; and conductive resin. Any of these materials is useful as the core body 12 of the electroconductive roll 10 in view of their strength and electrical characteristic.

The material and the surface treatment method of the core body 12 may be suitably selected according to the intended use such as that requiring sliding capability. The material of the core body 12 may be a material which does not substantially have electroconductivity. When a material which does not substantially have electroconductivity is used for forming the core body, the core body may be subjected to a generally-known treatment such as plating processing so that electroconductivity is imparted to the core body.

The outer diameter of the core body 12 may be suitably adjusted in accordance with members to which the electroconductive roll 10 is applied. For example, when the electroconductive roll 10 is mounted to an image forming apparatus explained below, the electroconductive roll 10 is arranged such that the electroconductive roll 10 contacts the outer peripheral surface of an image holding body or an intermediate transfer body of an image forming apparatus at a pressure required for image formation. For this reason, when the electroconductive roll 10 is used for the contact arrangement and the operation of the image forming apparatus, a material having a strength that is enough to prevent deflection of the electroconductive roll 10 may be used as the material of the core body 12, and the outer diameter of the core body 12 may be adjusted such that the core body 12 has sufficient rigidity over the length in the axial direction of the core body.

Elastic Layer

An elastic layer 14 is placed on the outer peripheral surface of the core body 12. The electroconductive roll 10 may have the core body 12 and the elastic layer 14 in which the elastic layer 14 is provided on or above an outer peripheral surface of the core body 12 and the surface layer 16 resides on or above an outer peripheral surface of the elastic layer 14. While the configuration of the electroconductive roll 10 of the present exemplary embodiment has an elastic layer 14 and a surface layer 16 which are sequentially provided in this order on the core body 12, the configuration of the electroconductive roll 10 is not limited thereto. The electro conductive roll 10 may have any configuration, provided that the surface layer 16 is arranged at the outermost peripheral surface side, and may further have other layers in the inner portion of the roll. For example, an adhesive layer (illustration is omitted) may be provided between the core body 12 and the elastic layer 14.

Adhesives that form the adhesive layer are not specifically limited, and examples of the adhesives include rubbers and resins such as those formed from polyolefin, chlorine rubber, acryl, epoxy, polyurethane, nitrile rubber, vinyl chloride, vinyl acetate, polyester, phenol or silicone rubber, and a silane coupling agent.

The adhesive layer may be a single layer formed from one adhesive or may have a configuration containing plural layers which are formed from different adhesives. The adhesive layer may further contain fine powders of a conductive material such as carbon black such as Ketjen Black or acetylene black; pyrolytic carbon, graphite; various metals or alloys thereof such as aluminum, copper, nickel, or stainless steel; various metal oxides such as tin oxide, indium oxide, titanium oxide, tin oxide-antimony oxide solid solution, or tin oxide-indium oxide solid solution; and insulating substances having a surface treated to be conductive. The thickness of the adhesive layer is not particularly limited. In view of obtaining sufficient adhesiveness, reduction of unevenness in thickness, and/or reduction of irregularity in resistivity, the thickness of adhesive layer may be preferably in a range of from 5 μm to 100 μm, and more preferably in a range of from 10 μm to 50 μm.

The elastic layer may be a single non-foamed layer, or may have a configuration in which a nonfoamed layer is provided on a surface (outside) of a foamed layer. In embodiments, the elastic layer may have a configuration containing plural foamed layers and/or plural nonfoamed layers.

The elastic layer refers to a layer formed of a material which returns to its original shape even when it is deformed by the application of an external force of 100 Pa.

The elastic layer 14 is a member which works, for example, as an electro conductive roll, to form a contact zone under an appropriate pressure and form an electric field. Therefore, in embodiments, the resistance of the elastic layer 14 may be adjusted. For example, the resistance may be adjusted by, for example, dispersing a conductive agent in a rubber material which forms the elastic layer 14.

Examples of the rubber material which forms the elastic layer 14 include epichlorohydrin, polyurethane, nitrile rubber, isoprene rubber, butadiene rubber, epichlorohydrin-ethylene oxide rubber, ethylene-propylene-diene rubber (EPDM), styrene-butadiene rubber (SBR), chlorinated polyisoprene, acrylonitrile-butadiene rubber (NBR), chloroprene rubber (CR), hydrogenated polybutadiene, butyl rubber, and silicone rubber, and blends of two or more of them. Preferable examples include urethane rubber, nitrile rubber, epichlorohydrin-ethylene oxide rubber, and ethylene-propylene-diene rubber (EPDM). Since these rubber materials have elasticity, any of them may be used as a material composing the elastic layer. In embodiments, a synthetic rubber having epichlorohydrin as a main component may be used because the rubber itself has a certain degree of electrical conductivity (ionic electoconductivity).

When the elastic layer 14 has a nonfoamed layer and a foamed layer, the main component of the rubber material is preferably an epichlorohydrin rubber, with which other one or more organic rubbers such as NBR, EPDM, SBR, or CR may be blended. Examples of the epichlorohydrin rubber which may be used as the main component of the nonfoamed layer and foamed layer include GECHRON 1100, GECHRON 3100, GECHRON 3101, GECHRON 3102, GECHRON 3103, GECHRON 3105, and GECHRON 3106 (trade names, manufactured by Zeon Corporation), which have different volume resistance values. Two or more of the products of different grades may be used in combination in view of achieving an intended resistance value.

Examples of the electroconductive agent contained in the elastic layer 14 include an electroconductive agent and an ionic electroconductive agent. Examples of the electroconductive agent include fine powders of carbon black such as Ketjen Black or acetylene black; pyrolytic carbon, graphite; various metals or alloys thereof such as aluminum, copper, nickel, or stainless steel; various metal oxides such as tin oxide, indium oxide, titanium oxide, tin oxide-antimony oxide solid solution, or tin oxide-indium oxide solid solution; and insulating substances having a surface treated to be conductive. Examples of the ionic electroconductive agent include perchlorates and chlorates such as tetraethyl ammonium or lauryltrimethyl ammonium; and alkali metals such as lithium and magnesium, perchlorates and chlorates of alkaline earth metals.

These conductive agents may be used alone or in combination of two or more of them. The addition amount of the agent is not particularly limited. In embodiments, the content of the electroconductive agent in the elastic layer 14 may be preferably in a range of from 1 parts by weight to 60 parts by weight, and more preferably in a range of from 10 parts by weight to 20 parts by weight, based on 100 parts by weight of the rubber material in the elastic layer 14. On the other hand, the content of the electroconductive agent in the elastic layer 14 may be preferably in a range of from 0.1 parts by weight to 5.0 parts by weight, and more preferably in a range of from 0.5 parts by weight to 3.0 parts by weight, based on 100 parts by weight of the rubber material in the elastic layer 14.

In this exemplary embodiment, the volume resistivity of elastic layer 14 is preferably in a range of from $10^6$ Ωcm to $10^9$ Ωcm, and more preferably in a range of from $10^6$ Ωcm to $10^8$ Ωcm. The method for measuring the volume resistivity is described below.

In embodiments, the hardness of the elastic layer may be in a range of from 15° to 90° in terms of the Ascar C hardness. When the Ascar C hardness is in a range of from 15° to 90°, the state of contact of the outer peripheral surface of the electroconductive roll 10 and an external member (such as an image holding member or an intermediate transfer body), which is positioned to contact the electroconductive roll 10, may be stabilized to result in suppression of occurrence of image quality defects, and decrease in the elasticity recovery force of the elastic layer 14 may be suppressed to result in enabling application of the electroconductive roll 10 to higher-speed processing.

The Ascar C hardness is measured by pressing a measuring stylus Ascar C type hardness meter (manufactured by Koubunshi Keiki Co., Ltd.) against the surface of a measuring sheet of 3 mm thickness under a load of 1,000 g.

The thickness of the elastic layer 14 may be preferably in a range of from 1.5 mm to 7 mm, and more preferably in a range of from 2 mm to 5 mm, from the viewpoints of obtaining sufficient deformation of the elastic layer 14 when the outer peripheral surface of the electroconductive roll 10 contacts an external member so that the contact portion can be stably formed, as well as making an apparatus to which the electroconductive roll 10 is provided be smaller.

In embodiments, a production method of the electroconductive roll 10 may include adjusting the outside surface of the electroconductive roll 10 to a desired shape (desired outside diameter) by polishing the surface of the elastic layer 14 after providing the elastic layer 14 directly on the core body 12 or over the core body 12 via the adhesive layer and/or the like. The method for polishing is not particularly limited, and may be a known method such as cylindrical polishing method (such as traverse polishing or plunge polishing) or centerless polishing method.

Surface Layer

Figure 1:
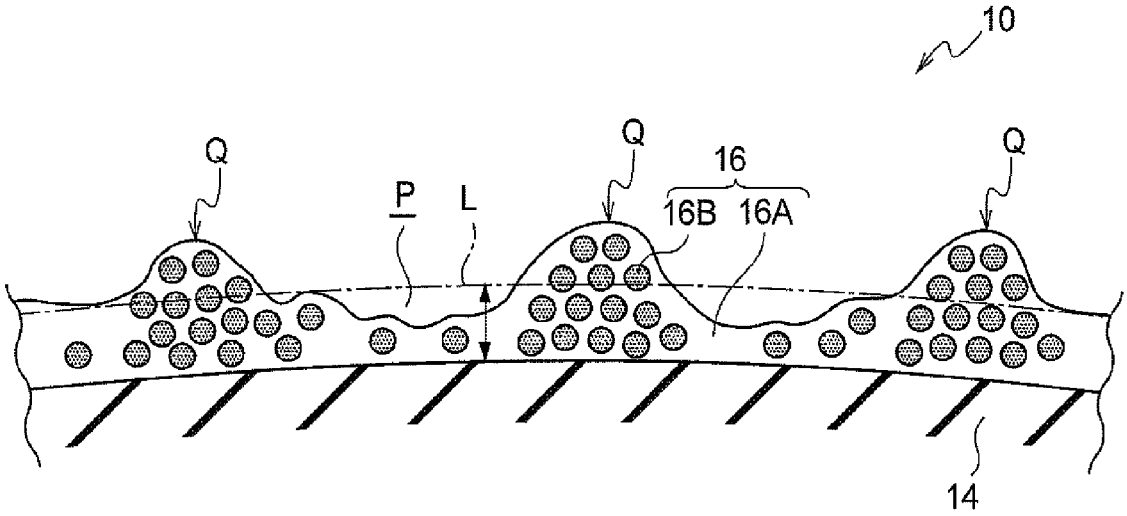
FIG. 1 is an enlarged schematic drawing of the surface portion of an electroconductive roll according to an exemplary embodiment.

As shown in FIG. 1, the surface layer 16 contains particles 16B in a resin material 16A, and has projections and recesses on its outer surface. Plural particles 16B are contained in projections Q of the projections and recesses. A ratio of an area occupied by particles existing in a cross-section of the projection is larger than a ratio of an area occupied by particles existing in the cross-section of the recess.

Namely, the electroconductive roll 10 has a configuration in which plural particles exist within each projection of the surface layer 16, and the ratio of the area occupied by particles existing in the cross-section of the projection to the entire area of the cross-section of the projection is larger in comparison with the ratio of the area occupied by particles existing in the cross-section of the recess to the entire area of the cross-section of the recess, thereby forming the projections and recesses on the surface of the roll.

Figure 3:
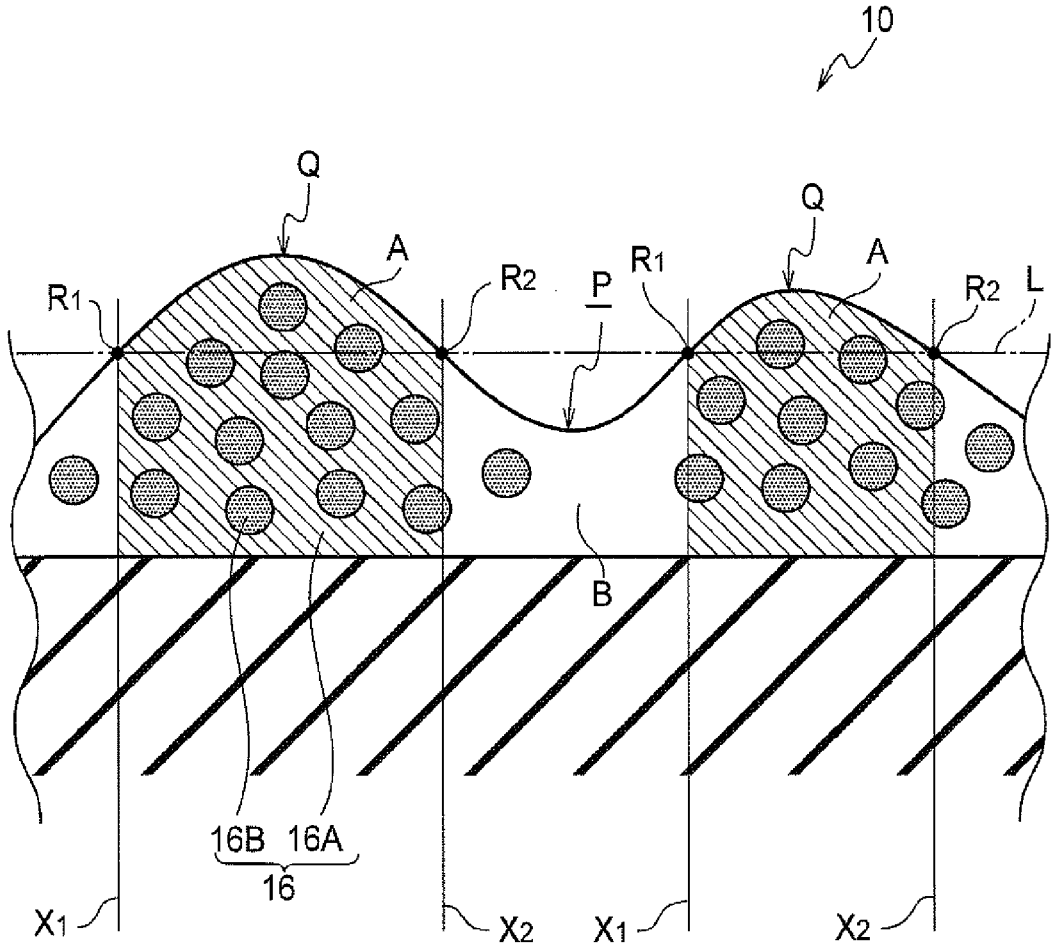
FIG. 3 is an enlarged schematic drawing of the surface portion of an electroconductive roll according to an exemplary embodiment.

In this exemplary embodiment, as shown in FIG. 3, the region "in the projection Q" means the cross-sectional region A in each projections in FIG. 3, and is the area between two lines (line $X_1$ and line $X_2$ in FIG. 3) which each extend vertically toward the elastic layer 14 from two intersection points (intersection point $R_1$ and intersection point $R_2$ in FIG. 3) on the line L, which represents a position corresponding to the average thickness of the surface layer 16, from positions at which line L intersects with a line representing the outermost peripheral surface in the cross-sectional profile of the projections Q.

Further, in this exemplary embodiment, as shown in FIG. 3, the regions "within the recesses P" means the cross-sectional regions B in the projections in FIG. 3, and are areas between two lines (line $X_1$ and line $X_2$ in FIG. 3) which each extend vertically toward the elastic layer 14 from two intersection points (intersection point $R_1$ and intersection point $R_2$ in FIG. 3) on the line L, which represents a position corresponding to the average thickness of the surface layer 16, from positions at which line L intersects with a line representing the outermost peripheral surface in the cross-sectional profile of the recesses P.

The state where "plural particles 16B exist in the projection Q" is specifically a state where plural particles 16B exist within the cross-sectional regions A.

The state where plural particles 16B exist within the projection Q may be determined in the following manner. For example, the cross-section when the surface layer 16 cut by a line elongating over plural projections Q in the surface layer 16 is observed, and ten projections Q among the plural projections are arbitrarily selected and observed. When plural particles 16B exist within each cross-sectional region A with respect to 70% or more of the selected projections Q, it is determined that the "state where plural particles 16B exist in the projection Q" is achieved.

The "ratio of the area occupied by particles 16B existing in the projection Q in the cross-section of the projection Q" herein means the ratio of the areas of regions occupied by particles 16B existing in the cross-sectional region A to the areas of the entire of the cross-sectional regions A, regarding the area of the entire of the cross-sectional region A as 100%.

This ratio may be calculated as follows. For example, a cross-section is firstly obtained by cutting the surface layer 16 by a plane which is vertical to the plane which corresponds to the average thickness of the surface layer 16 and includes a line elongating over plural projections Q in the surface layer 16. This cross-section is observed, and plural projections Q are selected by omitting the projection Q containing the maximum number and the projection Q containing the minimum number of particles among the observed plural projections Q. The ratio of the area occupied by particles 16B within the cross-sectional region A to the area of the entire of the cross-sectional region A is calculated. The average value of the calculation results for each of the selected projections Q is calculated. This average value is regarded as the ratio of the area occupied by particles 16B existing in the projection Q in the cross-section of the projection Q.

The "ratio of the area occupied by particles 16B existing in the recess P in the cross-section of the recess P" herein means the ratio of the areas of regions occupied by particles 16B existing in the cross-sectional region B to the areas of the entire of the cross-sectional regions B, regarding the area of the entire of the cross-sectional region B as 100%.

This ratio may be calculated as follows. For example, a cross-section is firstly obtained by cutting the surface layer 16 by a plane which is vertical to the plane which corresponds to the average thickness of the surface layer 16 and includes a line elongating over plural recesses P in the surface layer 16. This cross-section is observed, and plural recesses P are selected by omitting the recess P containing the maximum number and the recess P containing the minimum number of particles among the observed plural recesses P. The ratio of the area occupied by particles 16B within the cross-sectional region B to the area of the entire of the cross-sectional region B is calculated. The average value of the calculation results for each of the selected recesses P is calculated. This average value is regarded as the ratio of the area occupied by particles 16B existing in the recess P in the cross-section of the recess P.

The average layer thickness of the surface layer 16 is the value obtained in such a manner that the cross-section when the surface layer 16 cut by a line elongating over plural projections Q in the surface layer 16 is observed, the thicknesses of the projections Q at arbitrarily selected ten points in the cross-sectional profile and the thicknesses of the recesses P at arbitrarily selected ten points in the cross-sectional profile are measured, and the values of the thicknesses at the 20 points are averaged. The thickness of the projection Q is the distance from the peak of each projection Q to the surface of the elastic layer 14 (length of the perpendicular line drawn vertically from the peak of the projection Q to the surface of the elastic layer 14) in the cross-sectional profile. Further, the thickness of the recess P is the distance from the bottom (the most recessed point) of each recess P to the surface of the elastic layer 14 (length of the perpendicular line which is drawn vertically from the bottom of the recess P to the surface of the elastic layer 14) in the cross-sectional profile.

In the present exemplary embodiment, in the surface layer 16, the ratio of the area occupied by particles 16B existing in the cross-section of the projection Q to the entire area of the cross-section of the projection Q is larger than the ratio of the area occupied by particles 16B existing in the cross-section of the recess P to the entire area of the cross-section of the recesses P. Specifically, the ratio of the area occupied by particles 16B existing in the cross-section of the projection Q to the entire area of the cross-section of the projection Q is preferably from approximately 20% to approximately 80%, more preferably from approximately 30% to approximately 70%, and particularly preferably from approximately 30% to approximately 50%.

In the surface layer 16, when the ratio of the area occupied by particles 16B existing in the cross-section of the projection Q to the entire area of the cross-section of the projection Q is approximately 20% or more, the formation of the projections Q for suppressing the adhesion of various kinds of foreign matter to the surface of the surface layer 16 by the plural particles 16B, namely, the formation of the projections and recesses on the surface layer 16 of the electroconductive roll 10 of the present exemplary embodiment may be effectively achieved.

Further, when the ratio of the area occupied by particles 16B existing in the cross-section of the projection Q to the entire area of the cross-section of the projection Q is approximately 80% or less, the binding force between the particles 16B and the resin material 16A may be favorably maintained, and occurrence of cracking on the surface of the surface layer 16 having the projections Q, namely, occurrence of cracking on the surface layer 16, which has projections and recesses formed by plural particles 16B, may be effectively suppressed.

In the surface layer 16, the ratio A, that is a ratio of an area occupied by particles 16B existing in a cross-section of the projection Q to an entire area of the cross-section of the projection Q, is larger than the ratio B, that is a ratio of an area occupied by particles 16B existing in a cross-section of the recess P to an entire area of the cross-section of the recess Pin the surface layer 16. Namely, the relationship of A>B stands.

The relationship between A and B is preferably expresses by "A>B×n", in which n is an integer of one or more. The value of n is preferably from 1 to 5, and more preferably from 1 to 2, in view of resistance to staining of the peripheral surface of the surface layer 16.

The ten-point average roughness Rz of the outer peripheral surface of the surface layer 16 may be preferably from approximately 4 μm to approximately 20 μm, and more desirably from approximately 6 μm to approximately 13 μm. When the ten-point average roughness Rz of the outer peripheral surface of the surface layer 16 is in such range, occurrence of stains and cracks of the surface layer 16 may be suppressed when the electroconductive roll 10 is mounted to an image forming apparatus.

The ten-point average roughness Rz means the ten-point average roughness stipulated in JIS-B-0601 (1982), the disclosure of which is incorporated by reference herein. That is, the ten-point average roughness is the sum of: the average of the absolute values for the height from a standard height average line to the height of the highest through fifth highest peak; and the average of the absolute values for the depth from the standard height average line to depth of the deepest through fifth deepest valley in the portion sampled from a profile curve and having the reference length, and is expressed in terms of micrometer (μm).

This ten-point average roughness (Rz) is herein measured by a surface roughness measuring apparatus (trade name: SURFCOM 1500DX, manufactured by Tokyo Seimitsu Co., Ltd.), under the conditions of: measurement length=4 mm, cutoff wavelength=0.8 mm, measurement magnifications=1, 000, and measurement velocity=0.15 mm/second, with employing Gaussian for the type of cutoff and least square curve correction for the slope correction.

The average particle diameter of the particles 16B contained in the surface layer 16 is preferably in a range of from approximately 2 μm to approximately 15 μm, and more preferably from approximately 5 μm to approximately 10 μm. When the average diameter of the particles 16B is approximately 2 μm or more, projections and recesses which are sufficient to suppress the adhesion of foreign matter to the outer peripheral surface of the surface layer 16 may tend be formed on the surface of the surface layer 16 of the electroconductive roll 10. Further, concentrating of the stress to each particle of the particles 16B contained in the surface layer 16, which may occur when the electroconductive roll 10 is mounted to an image forming apparatus or a process cartridge and which may read to occurrence of cracking in the surface layer 16, may be suppressed when the average diameter of the particles 16B is approximately 15 μm or less.

The average particle diameter of the particles 16B is herein obtained by observing the particles 16B contained in the surface layer 16 using a scanning electron microscope (SEM) or a transmission electron microscope (TEM), and calculating the average value of the particle diameters measured from the areas of ten particles observed by the thus-observed SEM images or TEM images.

The flatness ratio of the particles 16B contained in the surface layer 16 is preferably from 0.5 to 1, and more preferably from 0.7 to 1.0.

In summary, in the present exemplary embodiment, when the surface layer 16 is formed by application of a coating liquid for forming the surface layer, distances between particles change as a result of displacement of the particles 16B that accompanies a convection of fluid in a coating layer 17 fowled on the elastic layer 14. Specifically, a region where particles are densely present due to attraction between particles, and a region where particles are sparsely present or are substantially absent are each formed in the coating liquid 17. Regions where particles are densely present form the projections Q, and regions where particles are sparsely present or are substantially absent form the recesses P, and together these foam the surface layer 16. It is thought that when the flatness ratio of the particles 16B is from 0.7 to 1.0, a force that attracts the particles 16B to one another is able to act more readily during the convection of the resin material 16A, thereby readily forming projections and recesses on the surface layer 16.

The flatness ratio of the particles 16B is determined according to the following Equality (1).

$$\text{Flatness ratio}=A/B \qquad \text{Equality (1)}$$

Here, B represents the absolute major axis of the particles 16B, and A represents the absolute minor axis of the particles 16B.

The flatness ratio is numerically expressed by analyzing, with an image analysis device, values of the absolute major axis and the absolute minor axis, which are mainly those measured from a microscopic image or a scanning electron microscopic image It is thought that the more the flatness approaches to 1.0, the more the particle approaches to a true sphere. The larger the flatness ratio becomes, the larger the difference in the absolute major axis and the absolute minor axis of the particle the particle having an ellipse shape is.

The true specific gravity of the particles 16B is preferably from 0.7 to 1.0, similarly to the flatness ratio, from the viewpoint of the ease of movement of the particles 16B in the resin material 16A accompanied by the convection of the resin material 16A at the time of forming the surface layer 16.

The following method is used for measuring the true specific gravity of the particles 16B.

The true specific gravity of the particle 16B is measured in accordance with 5-2-1 of JIS-K-0061, the disclosure of which is incorporated by reference herein, using a Le Chatelier flask. The operation is as follows.

(1) About 250 ml of ethyl alcohol is placed in a Le Chatelier flask, and the meniscus is adjusted to the position of the graduation.
(2) When the flask is immersed in a thermostat water bath, and the temperature becomes at 20.0° C.±0.2° C., the position of the meniscus is read correctly with the graduation of the flask (the accuracy is set to 0.025 ml).
(3) About 100 g of a sample is weighed, and the amount (weight) is precisely weighed, and the weighed amount is set to W (g).
(4) The weighed sample (particles 16B) is placed in the flask, and foam in the liquid is removed.
(5) When the flask is immersed in a thermostat water bath, and the temperature becomes at 20.0° C.±0.2° C., the position of the meniscus is read correctly with the graduation of the flask (the accuracy is set to 0.025 ml).
(6) The true specific gravity is calculated according to the following Equality.

$$D=W/(L_2-L_1)$$

$$S=D/0.9982$$

In Equality, D is the density (g/cm$^3$ at 20° C.) of the sample, S is the true specific gravity (20° C.) of the sample, W is the weight (g) of the sample, $L_1$ is the read value (ml) of meniscus at 20° C. before the sample is placed in the flask, $L_2$ is the read value (ml) of meniscus at 20° C. after the sample is placed in the flask, and the numeral of 0.9982 is the density (g/cm$^3$) of water at 20° C.

The particles 16B contained in the surface layer 16 are any particles as long as the particles 16B are particulate, satisfy the above requirements, and contribute the formation of the projections and recesses (specifically, formation of the projections Q) of the electroconductive roll 10 in the present exemplary embodiment, as a result of the movement of the particles 16B accompanied by the convection of the fluid in the coating layer 17 in the process of forming the surface layer 16, which are described below.

Examples of materials that form the particles 16B include resin materials, inorganic materials and the like.

Examples of resin materials include a polyamide resin, an acrylate resin, a silicone resin, a low density polyethylene (LDPE), a high density polyethylene (HDPE), an ethylene/acrylic acid copolymer (EAA), a crosslinked polymethyl methacrylate, a crosslinked polystyrene, a crosslinked polyacrylate, polymethyl methacrylate, nylon 12, nylon 6, nylon 6-12 and the like. Further, examples of inorganic materials include calcium carbonate, alumina, silica and the like. Of these materials, a crosslinked-type nylon resin is preferably used from the viewpoint of binding capability.

In embodiments, the particles 16B preferably have a strong binding force to the resin material 16A, from the viewpoint of suppressing effectively occurrence of cracking in the surface layer 16. In embodiments, the particles 16B are preferably porous from the viewpoint of realizing a strong binding force to the resin material 16A. Examples of constituent materials used for making the porous particles 16B include a polyamide resin, a polyimide resin, an acrylate resin, and calcium carbonate.

When the main component of the resin material 16A, which is described below, is a polyamide resin, it is desirable to use a polyamide resin as a material that forms porous particles 16B. The polyamide resin is preferable since the polyamide resin is, in addition to be compatible with the resin material 16A, expected to undergo a crosslinking reaction with N-methoxymethylated nylon to result in a stronger binding force between the resin material 16A and the particles 16B.

There is no particular limitation to a material used as the resin material 16A, and may be selected from any resins or rubbers. In embodiments, a polymer material may be preferably used as the resin material 16A. Examples of the polymer material include polyester, polyimide, copolymerized nylon, silicone resin, acrylic resin, polyvinyl butyral, ethylene-tetrafluoroethylene copolymer, melamine resin, fluorine rubber, epoxy resin, polycarbonate, polyvinyl alcohol, cellulose, polyvinylidene chloride, polyvinyl chloride, polyethylene, and ethylene-vinyl acetate copolymer.

Of the examples of the polymer materials to faint the resin material 16A, polyvinylidene fluoride, tetrafluoroethylene copolymer, polyester, polyimide and copolymerized nylon may be preferably used from the viewpoint of suppressing adhesion of stains to the surface of an electroconductive roll 10 when the electroconductive roll 10 is mounted to an image forming apparatus or a process cartridge and is operated. The copolymerized nylon contains one or plural selected from nylon 610, nylon 11 and nylon 12 nylon as a polymerization unit, and examples of other polymerization units which may be further contained in the copolymer include nylon 6 and nylon 66. The sum of the contents of the polymerization units formed from nylon 610, nylon 11 and nylon 12 is preferably 10% by weight or more based on the total mass of the copolymer. When the sum of the contents of the polymerization units is 10% by weight or more, a coating liquid for forming a coating layer 17 to produce the surface layer 16, which are described below, may exhibit excellent layer formability when the coating liquid is coated on the elastic layer 14. Further, suppression of the wear of the surface of the surface layer 16 and the adhesion of foreign matter to the outer peripheral surface of the surface layer 16 may be achieved, and excellent durability and smaller change in the characteristics due to the change in environmental conditions may be the electroconductive roll 10 may achieved, specifically when the electro conductive roll 10 is repeatedly used.

The polymer compound to form the resin material 16A may be used singly or in combination of two or more thereof. The number-average molecular weight of the polymer compound may be preferably in a range of from 1,000 to 100,000, and more preferably in a range of from 10,000 to 50,000.

The surface layer 16 may further contain a conductive material which is different from the particles 16B in view of regulating the resistivity. In embodiments, the average particle diameter of such additional conductive material may be about 3 μm or less in view of obtaining appropriate resistivity. regulation property. The average particle diameter of such additional conductive material may be measured in the same manner as that for the particles 16B. The additional conductive material may work for regulating the resistivity of the surface layer 16 as well as for improving the mechanical strength of the surface layer 16.

Examples of the additional conductive material include an electronic electroconductive agent such as carbon black or conductive metal oxide particles and an ionic electroconductive agent.

Specific examples of the carbon black include SPECIAL BLACK 350, SPECIAL BLACK 100, SPECIAL BLACK 250, SPECIAL BLACK 5, SPECIAL BLACK 4, SPECIAL BLACK 4A, SPECIAL BLACK 550, SPECIAL BLACK 6, COLOR BLACK FW200, COLOR BLACK FW2, and COLOR BLACK FW2V (all trade names, manufactured by Evonik Degussa GmbH); and MONARCH®1000, MONARCH®1300, MONARCH®1400, MOGUL®L, and REGAL 400R (trade name) (all manufactured by Cabot Corporation).

In embodiments, the pH value of carbon black may be 4.0 or less. Oxygen-containing functional groups which are present on the surface of the carbon black particles having a pH value of 4.0 or less may contribute to provide superior dispersibility to such carbon black in the resin material 16A as compared with that of general carbon black. Incorporation of carbon black having a pH value of 4.0 or less may contribute to provide the charging uniformity and suppression of fluctuation in resistance to the electroconductive material.

Any electroconductive particles may be used as the electroconductive metal oxide particles without specific limitations as long as the particles are electroconductive particles having electrons as charge carriers, and examples thereof include tin oxide, antimony-doped tin oxide, zinc oxide, anatase type titanium oxide, or indium tin oxide (ITO). These may be used alone, or two or more kinds may be used in combination. The electroconductive particles may have any particle diameter as long as the effect of the present exemplary embodiment is not impaired. Examples of the electroconductive particles which may be preferable from the viewpoint of regulation of the resistance and strength include tin oxide, antimony-doped tin oxide and anatase type titanium oxide, more preferable examples thereof include tin oxide and the antimony-doped tin oxide.

Examples of the ionic electroconductive agent include perchlorates and chlorates such as tetraethyl ammonium or lauryltrimethyl ammonium; and alkali metals such as lithium or magnesium, perchlorates and chlorates of alkaline earth metals.

These conductive agents may be used alone or in combination of two or more of them. The content of the electroconductive agent in the resin material 16 A is not particularly limited. In embodiments, the content of the electronic electroconductive agent may be preferably in a range of from 0.1 part by weight to 50 parts by weight, and more preferably in a range of from 5 parts by weight to 30 parts by weight, based on 100 parts by weight of the resin material 16 A. On the other hand, in embodiments, the content of the ionic electroconductive agent may be preferably in a range of from 1 part by weight to 10 parts by weight, and more preferably in a range of from 1 part by weight to 6 parts by weight, based on 100 parts by weight of the resin material 16 A.

In embodiments, the volume resistance value of the surface layer 16 may be preferably in a range of from $1\times10^{3}$ Ωcm to $1\times10^{10}$ Ωcm, and more preferably in a range of $1\times10^{4}$ Ωcm to $1\times10^{9}$ Ωcm. When the volume resistance value is less than $1\times10^{5}$ Ωcm, transfer failures may be suppressed in applications in which the electroconductive roll 10 is used as a transfer roll, and unevenness in charging may be suppressed in applications in which the electroconductive roll 10 is used as a charging roll. On the other hand, when the volume resistance value is higher than $1\times10^{10}$ Ωcm, discharging or image defects such as image deletion due to transfer failure may be suppressed in applications in which the electroconductive roll 10 is used as a transfer roll, and unevenness in image density may be suppressed in applications in which the electroconductive roll 10 is used as a charging roll.

The average thickness of the surface layer 16 is preferably in a range of from 0.1 μm to 30 μm, and more preferably in a range of from 0.5 μm to 20 μm. In embodiments in which the surface microhardness of the elastic layer 14 is less than 40°, the average thickness of the surface layer 16 may be preferably in a range of from 15 μm to 25 μm. In embodiments in which the surface microhardness of the elastic layer 14 is 40° or more, the average thickness of the surface layer 16 may be 5 μm or more.

Method for Manufacturing Electroconductive Roll

One exemplary embodiment of a method for manufacturing the electro conductive roll 10 is explained herein.

Preparation of Elastic Layer

Firstly, the elastic layer 14 is provided on a surface of the core body 12. Examples of the method for preparing the elastic layer 14 include a method including extrusion molding of a mixture of a rubber material, a vulcanizing agent, and a vulcanization accelerator, and heating the molded resultant for vulcanization.

Preparation of Surface Layer

The surface layer 16 is then provided on a surface of the elastic layer 14. Specifically, in this exemplary embodiment, the surface layer 16 is formed by applying a coating liquid for forming a surface layer. This coating liquid contains the resin material 16A, the particles 16B and other additives on the elastic layer 14.

In the present exemplary embodiment, the surface layer 16 has projections and recesses, plural particles 16B exist in the projections Q, and a ratio of an area occupied by particles existing in a cross-section of the projections to an entire area of the cross-section of the projections is larger than a ratio of an area occupied by particles existing in a cross-section of the recesses to an entire area of the cross-section of the recesses.

In the present exemplary embodiment, the projections and recesses of the surface layer 16 are formed by displacement of the particles 16B which accompanies with convention of any fluids in a coating layer 17 which is formed by applying the coating liquid for forming a surface layer on the elastic layer 14. The "fluid" means any liquid material(s) in the coating layer 17.

That is, in the present exemplary embodiment, distances between particles change as a result of displacement of the particles 16B which accompanies convention of any fluid, which is typically the resin material 16A, in the coating layer 17 formed on the elastic layer 14, such that a region where the particles 16B are densely present by a phenomenon in which the particles 16B attract with each other and a region where the particles 16B are sparsely present or are substantially absent are each formed in the coating layer 17. Regions where particles are densely present form the projections Q, and regions where particles are sparsely present or are substantially absent form the recesses P, and together these form the surface layer 16.

In other words, in the present exemplary embodiment, the projections and recesses are formed by regulating the distribution of the particles 16B in the coating layer 17 (or the surface layer 16).

The surface layer 16 having such projections and recesses may be formed by adjusting various conditions of the coating liquid for forming a surface layer or the drying conditions of the coating layer 17.

Various attempts to uniformly disperse particles in a surface layer of an elecroconductive roll have been conventionally made when the surface layer is provided over an elastic layer with containing particles in the surface layer. That is, attempts have been conventionally made to adjust a coating liquid for forming a surface layer so that the particles are uniformly dispersed in a coating layer (or the surface layer).

In contrast thereto, in this exemplary embodiment of the invention, the coating liquid 17 for forming a surface layer is not formulated to uniformly disperse the particles 16B in the surface layer 16 but is adjusted to form the region where the particles 16B are densely present and the region where the particles 16B are sparsely present or are substantially absent. The surface layer 16 having the projections and recesses is obtained as a result of this adjustment.

Figure 4:
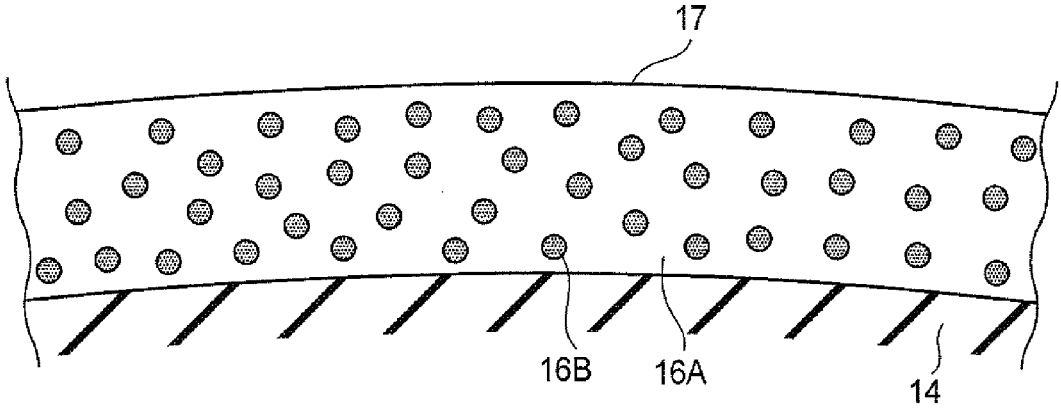
FIG. 4 is a schematic drawing showing manufacturing process of an electroconductive roll according to an exemplary embodiment.

Specifically, first, a coating layer 17 is formed by applying a coating liquid for forming a surface layer on the elastic layer 14 (see FIG. 4).

The coating liquid for forming a surface layer may contain a solvent, a dispersion auxiliary and/or the like in addition to the resin material 16A, the particles 16B and the electroconductive material.

Examples of the solvent which may be contained in the coating liquid for forming a surface layer include usual organic solvents such as methanol, ethanol, isopropanol, methyl ethyl ketone, or toluene and water.

Examples of the dispersion auxiliary which may be contained in the coating liquid include a surfactant and a coupling agent.

Examples of the coating method of the coating liquid for forming a surface layer on the elastic layer 14 include usual coating methods such as a spray coating method, a dip coating method, or a spin coating method. In embodiments, the dip coating method may be used from the viewpoint of the ease of regulation.

Figure 5:
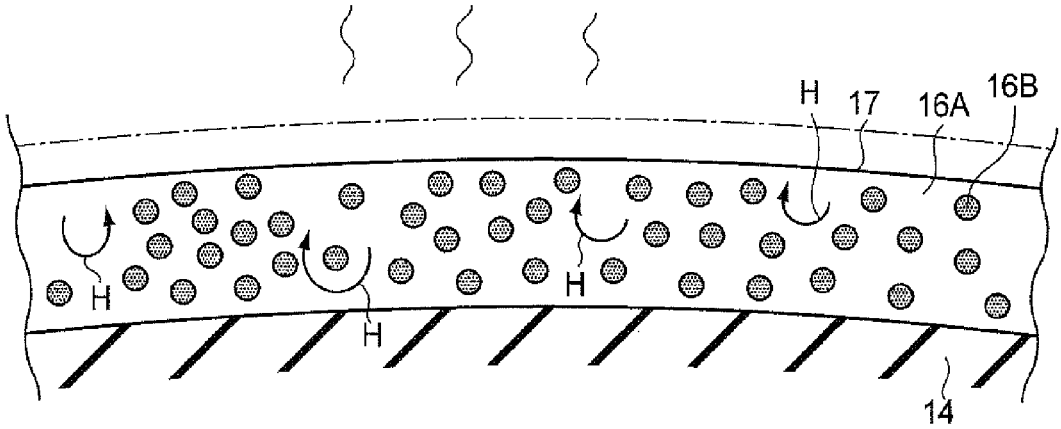
FIG. 5 is a schematic drawing showing manufacturing process of the surface layer of an electroconductive roll according to an exemplary embodiment.

Application of the coating liquid for forming a surface layer over the elastic layer 14 results in formation of a coating layer 17 which is formed from the coating liquid and is provided on the elastic layer 14. Evaporation of the solvent in the coating layer 17 or the like causes convection of a fluid such as the resin material 16A or a solvent in the coating layer 17 (for example, the convection in the direction of arrows H in FIG. 5). The particles 16B in the coating layer 17 are displaced in accordance with the convection, such that the distances between the particles 16B are changed from those before the occurrence of the convection. The formation of regions where the distances between the particles 16B have decreased corresponds to formation of regions where the densities of the particles 16B are higher. It is presumed that particles 16B which reside in regions other than the high-density regions are moved to the high-density regions according to convection of the fluid in the coating layer 17. Thus, the region where particles 16B are densely present and the region where particles 16B are sparsely present or are substantially absent are formed.

Figure 6:
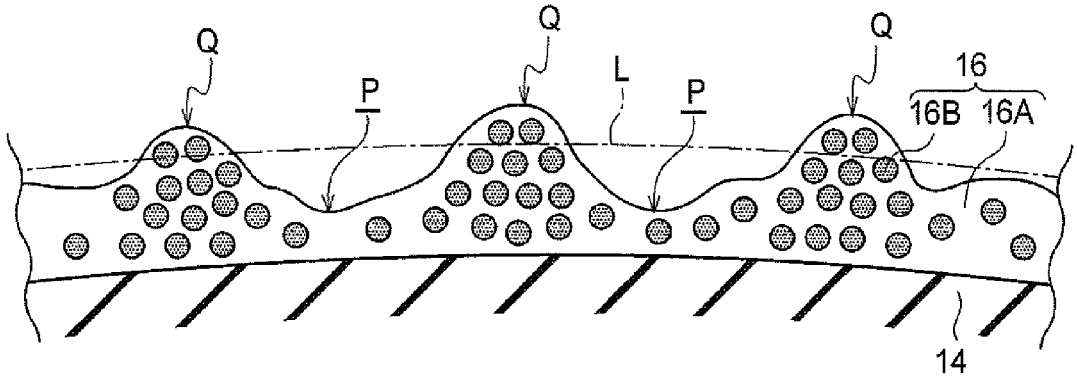
FIG. 6 is a schematic drawing showing manufacturing process of the surface layer of an electroconductive roll according to an exemplary embodiment.

Further, as the evaporation of the solvent proceeds and the particles 16B are further displaced by the convection, regions where the particles 16B are densely present is formed, resulting in the projections Q, and regions where the particles 16B are sparsely present or are substantially absent is formed, resulting in the recesses P, thereby forming the surface layer 16 (see FIG. 6).

In the present exemplary embodiment, the coating layer 17 is formed by applying the coating liquid for forming a surface layer on the elastic layer 14. The formation of the surface layer 16 is accompanied with the diversification of the distances among the particles 16B which are resulted from the convection of fluids such as the resin material 16A or a solvent in the coating layer 17. The surface layer 16 is formed to have a configuration that plural particles 16B exist at least in the projections Q resulting from the convection of the fluid, and the ratio of an area occupied by particles existing in a cross-section of the projection to an entire area of the cross-section of the projection being larger than the ratio of an area occupied by particles existing in a cross-section of the recess to an entire area of the cross-section of the recess. It may be thus regarded that the convection of the fluid including the resin material 16A in the coating layer 17 (coating liquid for forming a surface layer) contributes to the formation of the projections and recesses of the surface layer 16.

The convection of the fluid that forms the surface layer 16 having such projections and recesses may be adjusted by adjusting one or more conditions selected from the viscosity of the coating liquid for forming a surface layer that forms the coating layer 17, the kind or content of a solvent contained in the coating liquid for forming a surface layer, the evaporation condition of the solvent (namely, the drying condition of the coating layer 17), the average particle diameter of the particles 16B, the shape factor of the particles 16B, the content of the particles 16B, the true specific gravity of the particles 16B, the kind or content of the electroconductive materials, the kind, molecular weight or addition amount of the dispersion auxiliaries, the kind of the resin material 16A, the molecular weight of the resin material 16A, and the like. Further, it may be presumed that the moving rate of the particles 16B or the moving manner of the particles 16B in the directions of forming the projections Q and the recesses P accompanied by the convection may also be regulated by adjusting the viscosity of the coating liquid for forming a surface layer.

That is, the surface layer 16 having the projections and recesses may be formed by preparing the coating layer 17 by applying a coating layer for surface adjusted so as to satisfy one or more of these conditions, and/or adjusting the drying condition of the coating layer 17.

The movement of the particles 16B in the course of vaporization of a solvent tends to be inactive with an increase in the viscosity of the coating liquid for forming a surface layer that forms the coating layer 17, and the movement of the particles 16B tends to be active with a decrease in the viscosity of the coating liquid for forming a surface layer. That is, when the movement of the particles 16 becomes active, the regions where the particles 16B are densely present are easily formed. Therefore, the viscosity of the coating liquid for forming a surface layer may be adjusted for regulating the convection of the fluid that forms the surface layer 16 having projections and recesses.

Examples of the factors of the change in viscosity of the coating liquid for forming a surface layer that forms the coating layer 17 include: the viscosity of the resin material 16A in the coating liquid for forming a surface layer; and the ratio of a content of the resin material 16A to a content of a solvent in the coating liquid for forming a surface layer.

In general, a highly volatile solvent tends to cause the convection of a coating liquid. When the convection is actively caused, the regions where the particles 16B are densely present are tend to be easily formed. The kind or content of solvents contained in the coating liquid for forming a surface layer may be also adjusted for regulating the convention of the fluid that forms the surface layer 16 having projections and recesses.

Further, with regard to the evaporation conditions of the solvent contained in the coating liquid for forming a surface layer (namely, drying conditions of the coating layer 17), the solvent tends to easily evaporate as the drying temperature is higher. Accordingly, as the drying temperature becomes higher, the volatility of the solvent becomes higher, so that the convection of the fluid that forms the surface layer having projections and recesses becomes more active, and the regions where the particles 16B are densely present may tend to be easily formed as this convection is more active.

Moreover, with regard to the content of a solvent contained the coating liquid for forming a surface layer (namely, dilution ratio with solvent) and the kind of the solvent, as the content ratio of a highly volatile solvent becomes higher, the solvent is apt to be more easily evaporated. Accordingly, as the content ratio of the highly volatile solvent becomes higher, the volatility of the solvent becomes higher to lead more active convection of the fluid that forms the surface layer 16 having projections and recesses, and the regions where the particles 16B are densely present may tend to be easily formed as this convection is more active.

The average particle diameter of the particles 16B may be adjusted to be in a range of from 2 μm to 15 μm. When the average particle diameter of the particles 16B is within such range, the ratio of the area occupied by the particles 16 B existing in the projections Q in the cross-section of the projections Q and/or the dispersed state of the particles may be regulated so as to adjust the convection of the fluid in the coating liquid for forming a surface layer of the coating layer 17 is adjusted such that the projections and recesses of the surface layer 16 may be formed.

Further, the flatness ratio of the particles 16B may be adjusted to be in a range of from 0.7 to 1.0. When the flatness ratio is within such range, the regions where the particles 16B are densely present by mutual attraction of the particles 16B caused by the convection may be easily formed.

Further, the true specific gravity of the particles 16B may be adjusted to be in a range of from 0.7 to 1.0. When the true specific gravity of the particles 16B is within such range, the easiness of the movement of the particles 16B in the resin material 16A accompanied by the convection of the resin material 16A may be appropriately adjusted.

Further, the viscosity of the coating liquid for forming a surface layer and the ease of movement of the particles 16B accompanied by the convection may be adjusted by adjusting the kind, molecular weight or addition amount of dispersion auxiliaries.

Moreover, the velocity of movement of the particles 16B accompanied by the convection, and the manner of the movement of the particles 16B in the directions of forming the projections Q and the recesses P may be regulated by adjusting the viscosity of the coating liquid for forming a surface layer.

The viscosity of the coating liquid for forming a surface layer may be adjusted by adjusting one or more conditions selected from the kind or content of the electroconductive materials contained in the coating liquid for forming a surface layer, the kind or content (dilution ratio with solvent) of solvents contained in the coating liquid for forming a surface layer, the molecular weight of the resin material 16A, the structure of the resin material 16A, the formulation of the resin material 16A, and the kind of one or more catalyst(s) when the resin material 16A is a crosslinking resin.

Specifically, in embodiments, the viscosity of the coating liquid for forming a surface layer may be in a range of from 20 mPa·s to 50 mPa·s, and preferably in a range of 30 mPa·s to 40 mPa·s. When the viscosity of the coating liquid for forming a surface layer is from in a range of 30 mPa·s to 40 mPa·s, the projections and recesses of the surface layer may be appropriately formed, although the condition of the projections and recesses may also depend on other factors.

The viscosity is measured under the conditions of 25° C. and 55% RH by using a viscometer (trade name: VISCOMETER MODEL B-8L, manufactured by Toki Sangyo Co., Ltd.).

The evaporation conditions of the solvent contained in the coating liquid for forming a surface layer may be regulated by adjusting the kind of the solvent or the content of the solvent and the environmental temperature and humidity under which the solvent is evaporated.

The drying rate of the coating layer 17, namely, the evaporation speed of a solvent is thought as affecting the flatness of the surface layer 16 to be formed. The drying rate of the coating layer 17 may be easily regulated by adjusting at least one of the molecular weight of the resin material 16A, the content of an electroconductive material in the coating liquid for forming a surface layer, the ratio of the content of the resin material 16A to that of the solvent (resin ratio), the ratio of the content of an alcohol and that of water in the case that the alcohol and water are contained, the kind of a leveling agent and the like.

In the present exemplary embodiment, the "drying rate of the coating layer 17" means the time length (rate) from the formation of the coating layer 17 by coating a coating liquid for forming a surface layer on the elastic layer 14 to the time when the coating layer 17 reaches the state of being "dried", in which the expression of the coating layer being "dried" means that 85% or more of the solvents such as water or alcohol in the coating layer 17 is volatilized or evaporated from the coating layer 17.

The electroconductive roll 10 of the present exemplary embodiment in which a longer operating life is achieved by suppressing occurrence of cracking on the peripheral surface and the adhesion or deposition of foreign matter to the peripheral surface is suppressed may be manufactured by performing this manufacturing method.

The electroconductive roll 10 may be used as, for example, a charging roll or a transfer roll which forms an image forming apparatus. Further, when the electroconductive roll 10 is applied to an image forming apparatus which forms an image on a recording medium using an intermediate transfer body in the image forming apparatus, the electroconductive roll 10 may be used as a primary transfer roll and/or a secondary transfer roll as the charging roll and/or the transfer roll.

The hardness of the electroconductive roll 10 of the present exemplary embodiment is preferably in a range of from ASKER C15 to ASKER C90, and more preferably in a range of from ASKER C20 to ASKER C50, in terms of the ASKER C hardness. When the hardness is ASKER C15 or more, the deformation of the electroconductive roll 10 due to an external pressure may be suppressed.

When the hardness is ASKER C90 or less, deterioration of image quality, which may occur due to the concentration of load by a pressing force to an image holding body (described below) which is arranged in contact with the electroconductive roll 10 when the electroconductive roll 10 is mounted to an image forming apparatus, may be suppressed.

The "electroconductivity" of the electroconductive roll 10 herein means that the volume resistivity ρ of the entire of the electroconductive roll 10 is less than $10^{13}$ Ωcm. The volume resistivity ρ is measured in such a manner that the electroconductive roll 10 is placed on a flat metal plate (material: SUS 304 stainless steel; surface roughness Ra: 0.1 μm to 0.2 μm), and in the state where the weights of 500 g are placed on the both ends in the axial direction of a core body 12 as a rotation shaft of the electroconductive roll 10, to apply a load to the electroconductive roll 10, and the core body 12 and the metal plate are connected to a resistance meter (trade name: R8340A DIGITAL ULTRA-HIGH RESISTANCE/MICRO CURRENT METER; manufactured by Advantest Corporation), and based on the current value after a voltage of 100 V is applied from the resistance meter to the electroconductive roll 10 for 10 seconds, the volume resistivity ρ is obtained according to Equality $\rho=V/I\times A/t$. Here, in Equality, V represents an applied voltage (V), I represents a current value (A), A represents an electrode contact area ($cm^2$) and t represents a layer thickness (cm). Further, the volume resistivity of the core body 12 that constitutes the electroconductive roll 10 is measured by the same method as that of the electroconductive roll 10.

When the volume resistivity of the elastic layer 14 and the volume resistivity of the surface layer 16 are measured, a sheet (hereinafter, referred to as a "composition sheet") which is formed from only of the composition for each layer is used so that the volume resistivity for each layer may be separately measured. Specifically, an electrode (trade name: R12702 A/B RESISTIVITY CHAMBER; manufactured by Advantest corporation) is attached to both surfaces of the composition sheet, a ring-shaped ground electrode is further attached to one surface of the composition sheet such that the ground electrode is coaxial to the electrode, and a resistance meter (trade name: R8340A DIGITAL ULTRA-HIGH RESISTANCE/MICRO CURRENT METER; manufactured by Advantest Corporation) is connected to these electrodes.

A voltage which is regulated such that an electric field (applied voltage/thickness of composition sheet) is 100 V/cm under the conditions of 22° C. and 55% RH is applied to these electrodes so that the voltage is applied to the composition sheet and a volume resistivity (Ω·m) is calculated by the following Equality (2) based on the current value after the voltage application for 30 seconds;

$$\text{Volume resistivity}(\Omega\cdot m)=19.63\times\text{applied voltage }(V)/\text{current value }(A)/\text{thickness}(cm)\text{of composition} \quad \text{Equality (2)}$$

Image Forming Apparatus and Process Cartridge

Hereinafter, an exemplary embodiment of an image forming apparatus and an exemplary embodiment of a process cartridge to which the electroconductive roll 10 is mounted are explained.

Figure 7:
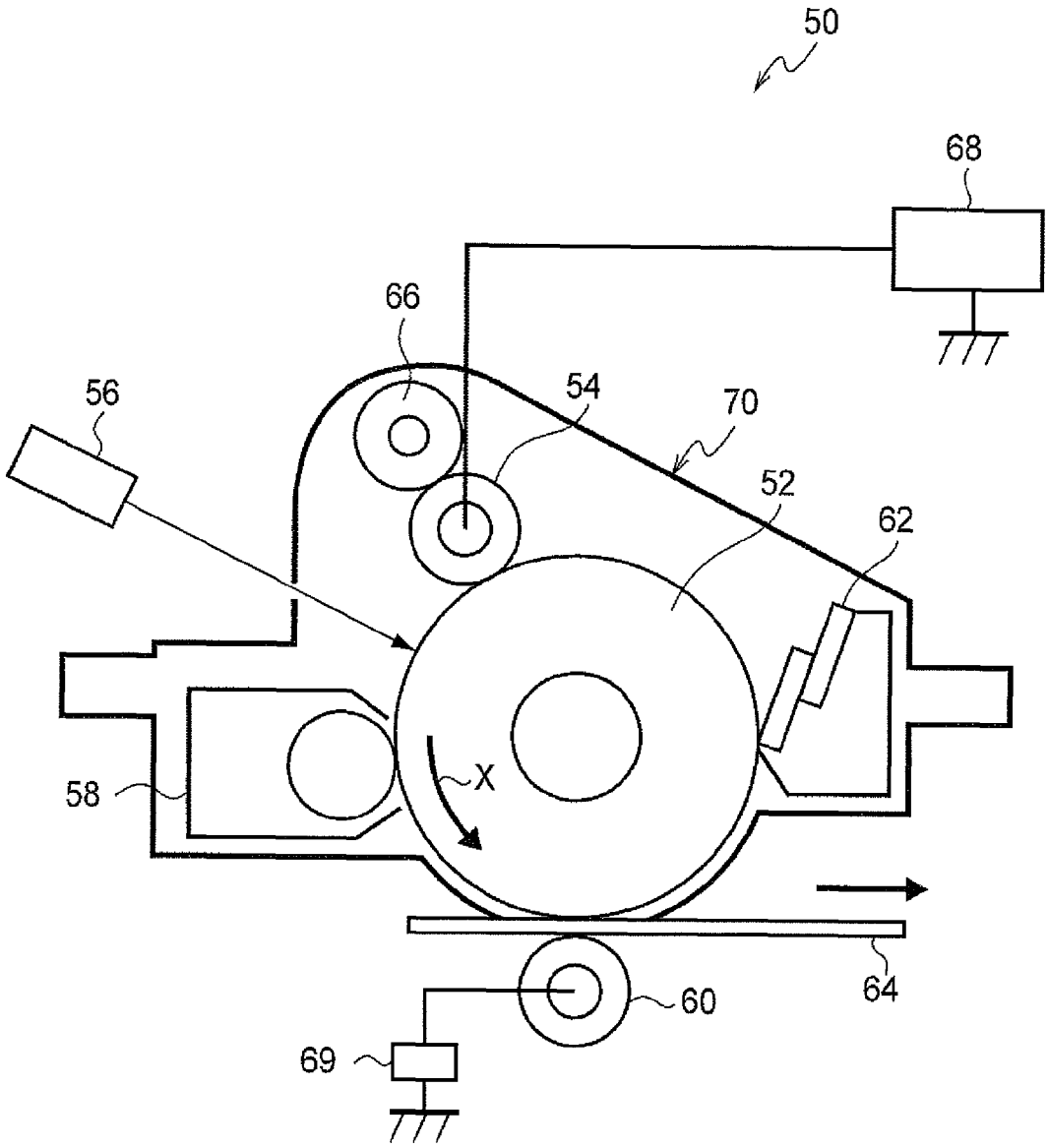
FIG. 7 is a schematic drawing showing a process cartridge and an image forming apparatus according to an exemplary embodiment.

FIG. 7 shows an image forming apparatus 50 equipped with an image holding body 52 which is rotated in the predetermined direction (the arrow direction of X in FIG. 7). A charging roll 54, an exposure device 56, a developing device 58, a transfer roll 60 and a cleaning blade 62 are placed on the periphery of the image holding body 52 in this order in sequence along the rotational direction of the image holding body 52.

The charging roll 54 is placed in contact with the outer peripheral surface of the image holding body 52, and charges the surface of the image holding body 52. The charging roll 54 has a core material (illustration is omitted) formed on the shaft of the charging roll 54, and the core material is electrically connected to a power source 68. Accordingly, an electric field is formed between the charging roll 54 and the image holding body 52 by applying a voltage to the core material from the power source 68, thereby charging the surface of the image holding body 52.

The cleaning roll 66 is arranged in contact with the outer peripheral surface of the charging roll 54 for removing foreign substances which adhere to the outer peripheral surface of the charging roll 54. Foreign substances such as toner, paper powder, a releasing agent and the like which are adhering to the outer peripheral surface of the charging roll 54 are removed with the cleaning roll 66.

The exposure device 56 forms an electrostatic latent image corresponding to an image on the image holding body 52 charged with the charging roll 54. The developing device 58 develops the electrostatic latent image formed on the image holding body 52 with toner to form a toner image. The recording medium 64 transfers the toner image formed on the image holding body 52 with the transfer roll 60. The transfer roll 60 is placed at the position where the recording medium 64 is nipped and conveyed between the transfer roll 60 and the image holding body 52, and an electric field is formed between the transfer roll 60 and the image holding body 52 to transfer the toner that forms the toner image held on the image holding body 52 to the side of the recording medium 64, thereby transferring the toner image to the recording medium 64.

The transfer roll 60 has a core material (illustration is omitted) formed on the shaft of the transfer roll 60, and the core material is electrically connected to a power source 69. Accordingly, an electric field is formed between the transfer roll 60 and the image holding body 52 by applying a voltage to the core material from the power source 69, and the toner image held on the surface of the image holding body 52 is transferred to the side of the recording medium 64, thereby transferring the toner image onto the recording medium 64.

The toner image transferred to the recording medium 64 is fixed on the recording medium 64 with a fixing device (illustration is omitted).

In the present exemplary embodiment, the charging roll 54, the cleaning roll 66, the image holding body 52, the cleaning blade 62 and the developing device 58 are integrally provided in a process cartridge 70 which is detachably mounted to the image forming apparatus 50.

Although the image forming apparatus of the present exemplary embodiment, that has a configuration in which the process cartridge 70 includes the charging roll 54, the cleaning roll 66, developing device 58, the image holding body 52 and the cleaning blade 62, is herein explained, the configuration of the process cartridge 70 is not restricted to this. Any configuration may be employed in the process cartridge 70 as long as it includes at least one of the charging roll 54 and the transfer roll 60.

In the image forming apparatus 50, the image holding body 52 having a surface which is uniformly charged with the charging roll 54 is rotated in the predetermined direction (the arrow direction X in FIG. 7). An electrostatic latent image is formed on the surface of the charged image holding device 52 by the exposure device 56. When the region where the electrostatic latent image is formed reaches the region where the developing device 58 is arranged according to the rotation of the image holding body 52, the electrostatic latent image is developed by the developing device 58 to form a toner image. When the toner image formed on the image holding body 52 reaches the position where the transfer roll 60 is arranged according to the rotation of the image holding body 52, the toner image is transferred, by the transfer roll 60, to the recording medium 64 conveyed between the image holding body 52 and the transfer roll 60 by a conveyer (illustration is omitted). The toner image transferred to the recording medium 64 is fixed by the fixing device (illustration is omitted). Thus, an image is formed on the recording medium 64. Foreign substances such as paper powder, a remaining toner and/or the like adhering to the image holding body 52 are removed from on the image holding body 52 with the cleaning blade 62.

In addition, a series of processes from the charging of the image holding body 52 with the charging roll 54 to the image forming on the recording medium 64 performed by driving various devices is herein referred to as an image forming process.

The electroconductive roll 10 of the present exemplary embodiment may be suitably used as the charging roll 54 and the transfer roll 60 of the image forming apparatus 50.

Figure 8:
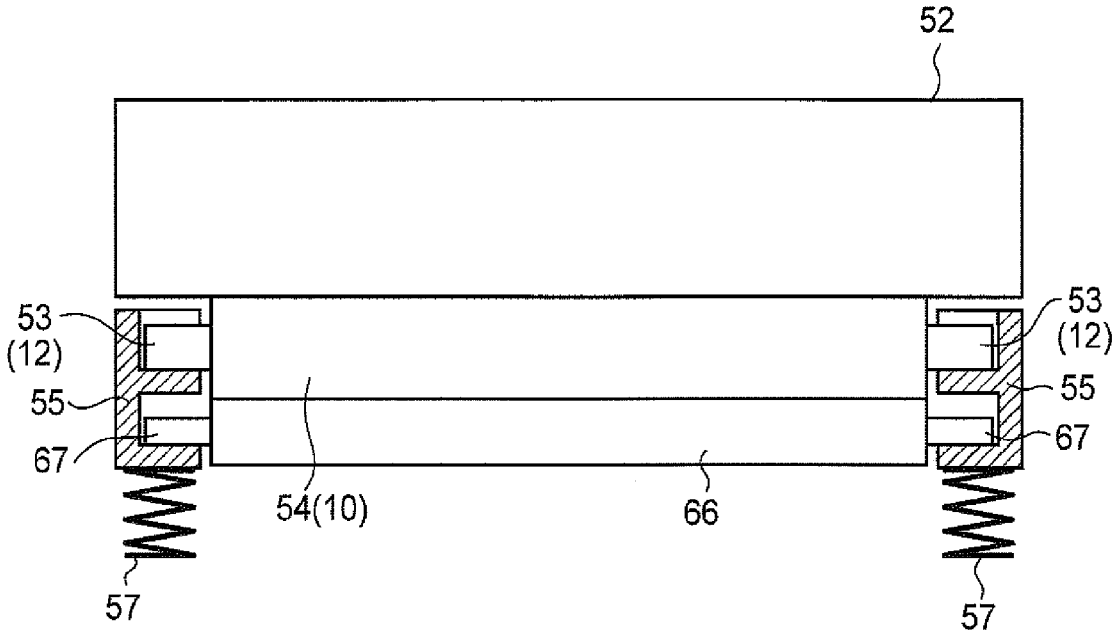
FIG. 8 is a schematic drawing in which an electroconductive roll according to an exemplary embodiment is applied to an image forming apparatus and a process cartridge.

The charging roll 54 is arranged in contact with the outer peripheral surface of the image holding body 52. More specifically, as shown in FIG. 8, the charging roll 54 is supported by a bearing member 55 at both ends in the longitudinal direction of an electroconductive core body 53 formed as the rotational shaft of the charging roll 54. The bearing members 55 each are supported by a coiled spring 57 supported by a housing (illustration is omitted). Therefore, the charging roll 54 is arranged in contact with image holding body 52 such that the outer peripheral surface of the charging roll 54 is pressed against the outer peripheral surface of the image holding body 52 through the core body 53 by the coil springs 57. Accordingly, the charging roll 54 arranged in contact with the image holding body 52 is driven-rotated according to the rotation of the image holding body 52. Alternatively, the charging roll 54 may rotate independently from the rotation of the image holding body 52.

The bearing members 55 further support the both ends in the longitudinal direction of the core body 67 which is the shaft of the cleaning roll 66, and thus the bearing members 55 support the cleaning roll 66 and the charging roll 54 such that the outer peripheral surface of the cleaning roll 66 is arranged in contact with the outer peripheral surface of the charging roll 54. Accordingly, the cleaning roll 66 is driven-rotated with the rotation of the charging roll 54. Alternatively, the cleaning roll 66 may rotate independently from the rotation of the charging roll 54.

When the electroconductive roll 10 is used as the charging roll 54, occurrence of cracking on the outer peripheral surface of the charging roll 54 may be suppressed even when the image forming process is performed in the image forming apparatus 50, because the surface layer 16 is in the state where occurrence of cracking is suppressed. Therefore, uneven charging of the surface of the image holding body 52 resulting from cracks on the surface of the charging roll 54 may be thus suppressed. Further, oozing of various kinds of materials such as electro conductive materials or the like from the elastic layer 14 resulting from the occurrence of cracking in the outer peripheral surface of the charging roll 54 may be suppressed.

Accordingly, the application of the electroconductive roll 10 as the charging roll 54 may result in uniform charging of the surface of the image holding body 52 and suppressing occurrence of density unevenness and color streaks resulting from poor charging of the surface of the image holding body 52, which may lead to suppression of deterioration of image quality. Further, the operating life of the charging roll 54 may become longer.

Further, fixation and deposition of various kinds of foreign matters (such as toner, paper powder, or a releasing agent which are remaining without being removed from the outer peripheral surface of the charging roll 54 by the cleaning roll 66) onto the outer peripheral surface may be suppressed by using the electroconductive roll 10 as the charging roll 54, because the surface layer 16 has the projections and recesses.

When the electroconductive roll 10 is used as the transfer roll 60, occurrence of cracking on the outer peripheral surface of the transfer roll 60 may be suppressed even when the image forming process is performed in the image forming apparatus 50, because the surface layer 16 is in the state where occurrence of cracking is suppressed. Therefore, poor transfer due to uneven intensity of electric field for transferring toner that configures the toner image held on the image holding body 52 to the recording medium 64 resulting from cracks on the surface of the transfer roll 60 may be suppressed. Further, oozing of various kinds of materials such as electroconductive materials or the like from the elastic layer 14 resulting from the occurrence of cracking in the outer peripheral surface of the transfer roll 60 may be suppressed, which may lead to suppression of staining of the recording medium 64.

Accordingly, the application of the electroconductive roll 10 as the transfer roll 60 may result in suppression of poor transfer of the toner image held by the image holding body 52 and deterioration of image quality. Further, the operating life of the transfer roll 60 may become longer.

Further, fixation and deposition of various kinds of foreign matters (such as toner, paper powder, or a releasing agent which are remaining on the outer peripheral surface of the transfer roll 60) onto the outer peripheral surface of the transfer roll 60 may be suppressed by using the electroconductive roll 10 as the transfer roll 6, because the surface layer 16 has the projections and recesses.

The application of the electroconductive roll 10 is not limited to the charging roll 54 and the transfer roll 60 of the process cartridge 70 or the image forming apparatus 50 of the present exemplary embodiment. The electroconductive roll 10 may be applied to various electroconductive rolls in an image forming apparatus.

For example, when the image forming apparatus in which a toner image is formed on a recording medium via an intermediate transfer body is used, the electroconductive roll 10 may be used as a primary transfer roll which transfers a toner image held on an image holding body 52 to an intermediate transfer body, a secondary transfer roll that transfers the toner image which has been transferred to the intermediate transfer body to a recording medium, and/or a backup roll, thereby suppressing the deterioration of image quality.

EXAMPLES

The invention is further illustrated in reference to following Examples. However, the invention is not limited to the Examples. In the following illustration, all "parts" and "%" mean "parts by weight" and "% by weight", respectively, unless otherwise noted.

Example 1

| Preparation of Electroconductive roll<br>Preparation of Elastic layer<br>Formulation of Elastic layer | |
|---|---|
| Epichlorohydrin rubber (trade name: 3106; manufactured by Zeon Corporation) | 100 parts by weight |
| Carbon black (trade name: ASAHI #60; manufactured by Asahi Carbon Co., Ltd.) | 10 parts by weight |
| Calcium carbonate (trade name: WHITON SB; Shiraishi Calcium Kaisha Ltd.) | 20 parts by weight |
| Ion conductive agent (trade name: BTEAC; manufactured by Lion Akzo Co., Ltd.) | 5 parts by weight |
| Vulcanization accelerator (stearic acid; manufactured by NOF Corporation) | 1 part by weight |
| Vulcanizing agent: Sulfur (trade name: VULNOC R; manufactured by Ouchi Shinko Chemical Industrial Co., Ltd.) | 1 part by weight |
| Thiuram-containing vulcanization accelerator (trade name: NOCCELER TET-G; manufactured by Ouchi Shinko Chemical Industrial Co., Ltd) | 1.5 parts by weight |
| Thiazole-containing vulcanization accelerator (trade name: NOCCELER DM-P; manufactured by Ouchi Shinko Chemical Industrial Co., Ltd) | 1 part by weight |

Firstly, the epichlorohydrin rubber is masticated with 12-inch open rolls for 3 minutes. Carbon black, calcium carbonate and the ion conductive agent of the materials of forming the elastic layer are slowly added to the epichlorohydrin rubber during the rotation of the open rolls, and then the vulcanizing agent, the two vulcanization accelerators are added to the mixture and the resultant mixture is kneaded for 5 minutes, thereby preparing a raw rubber.

A core body having a shaft made of sulfur free-cutting steel (a steel material "SUM24L" that is defined by JIS G4804, the disclosure of which is incorporated by reference herein, and that contains 0.15% or less of C, 0.85% to 1.15% of Mn, 0.04% to 0.09% of P, 0.26% to 0.35% of S, and 0.10% to 0.35% of Pb) with a diameter of 8 mm and a length of 310 mm and the surface of which being subjected to a nickel plating and chromate treatment is prepared. The surface of the core body is coated with an adhesive by using a brush, and the coated cored body is air-dried, thereby an adhesive layer having a thickness of 10 μm.

Herein, the adhesive has been prepared by mixing (dispersing) a mixture containing 3.0 parts by weight of an electroconductive agent (trade name: KETJENBLACK EC; manufactured by Lion Corporation) in 100 parts by weight of a polyolefin adhesive (trade name: CHEMLOK250X; manufactured by Load Far East Incorporated) with a ball mill for 24 hours.

A cylindrical metal mold having an inner diameter of 14.5 mm for injection molding is prepared. The cylindrical metal mold is maintained at 170° C.±5° C. with a heater, and the core body is set in the mold. Thereafter, the prepared raw rubber is injected into the metal mold from an injection molding machine and is maintained for 3 minutes, thereafter, the thus-molded roll member is taken out of the metal mold.

The roll member taken out of from the metal mold is allowed to stand for 4 hours in order to lower the temperature and stabilize the diameter of the roll member. Thereafter, the roll member is finished to have an outer diameter of 14 mm by using a traverse grinding machine having a grain size #60 grindstone, thereby forming an elastic layer provided on the core body.

The surface roughness of the elastic layer is 2.8 μm in terms of Rz, and the outer diameter of the central portion is about 55 μm larger than that of the end portions (crown shape). The volume resistivity of the elastic layer is $3\times10^6$ Ω·cm and the ASKER C hardness is ASKER C76 under the conditions of 22° C. and 55% RH.

Preparation of Surface Layer 6-nylon (registered trademark: FINE RESIN® FR101; manufactured by Namariichi Co., Ltd.) having a methoxy methylation rate of about 30% and a molecular weight of about 20,000 is selected as the resin material 16A. The resin material (10 parts by weight) is dissolved in 75 parts by weight of methanol, 20 parts by weight of n-butanol, 5 parts by weight of water and 0.3 part of citric acid, and the resultant liquid is allowed to stand for 10 hours to form a solution. Thereafter, 20 parts by weight of carbon black is added to the solution, and the resulted mixture is subjected a dispersion process by using DYNOMILL for 60 minutes, thereby preparing an electroconductive liquid for forming a surface layer material. 35 parts by weight of nylon particles having an average particle diameter of 5 μm is added as the particles 16B to 100 parts by weight of the solid content in the prepared electroconductive liquid for forming a surface layer material, so that a coating liquid for forming a surface layer is prepared.

The viscosity of the coating liquid for forming a surface layer measured by using a viscometer (trade name: VISCOMETER MODEL BL2; manufactured by Toki Sangyo Co., Ltd.) is 34.5 mPa·s under the conditions of 24° C. and 55% RH at 60 rpm.

Next, the coating liquid for forming a surface layer is placed in a dip coating vessel. The roll member having the elastic layer is immersed into the vessel at a speed of 300 mm/m, and after the roll member is maintained for 3 seconds in a state where the entire of the elastic layer is immersed in the liquid, the roll member is salvaged at a speed of 200 mm/m. In this way, a coating layer 17 is formed on the elastic layer by the dip coating method.

After the coating layer is formed by applying the coating liquid for forming a surface layer onto the elastic layer by the dip coating method, the roll member having the coating layer on the elastic layer is dried under the conditions of room temperature (22° C.) and a humidity of 50% RH to 60% RH for one minute. When the surface of the coating layer 17 after the drying is checked with an optical microscope, projections and recesses are observed on the surface of the layer. Accordingly, it is thought that the convection of the fluid in the coating liquid for forming a surface layer arises and the particles 16B are moved during the one minute-drying performed after the salvage to form the surface projections and recesses.

After the one minute-drying, the roll member is placed in a heating furnace heated at 160° C., and baked for 20 minutes, and the roll member is taken out from the heating furnace and cooled at room temperature, thereby preparing an electroconductive roll A1.

The electroconductive roll A1 is measured by a surface roughness measuring device (trade name: SURFCOM 1500DX; manufactured by Tokyo Seimitsu Co., Ltd.), under the conditions of: measurement length of 4 mm, cutoff wavelength of 0.8 mm, measurement magnifications of 1,000, and measurement velocity of 0.15 mm/second, with Gaussian cutoff and slope correction of least square curve correction in accordance with JIS-B-0601 (1982) (the disclosure of which is incorporated by reference herein).

The thus-measured ten-point average roughness Rz of the electroconductive roll A1 is 7 μm.

Evaluation

Observation of Cross-sectional Profile

A sample for observing a cross-sectional profile of the electroconductive roll A1 is prepared as follows. First, the produced electroconductive roll 1 is cut from the surface side to the elastic layer with a razor to take out a rough sample. After the rough sample taken out is frozen at −130° C. with liquid nitrogen and is cut in the frozen state, the cut surface is smoothened using a Cryo Mictotome to provide a sample for observation.

The cross-sectional profile of this sample is observed using a color 3D laser beam microscope (trade name: VK8550; manufactured by Keyence Corporation) with an object lens of 50 magnifications.

Measurement of Average Thickness of Surface Layer

The cross-sectional profile is observed, the thicknesses of ten arbitrary projections Q and the thicknesses of ten arbitrary recesses P in the cross-sectional profile are measured, and the average value of the 20 thicknesses measured in total is calculated as the average thickness of the surface layer. The average thickness of the surface layer is 9 μm.

Count of Number of Particles 16B Existing in Projection Q

Ten projections are arbitrarily selected from plural projections Q observed in the cross-sectional profile of the sample. The number of particles existing in these selected projections Q is counted. It is observed that 7 or more particles 16B exist in 70% or more of the selected projections Q. It is further observed that the average number of the particles 16B existing in these projections Q is 11.

As shown in FIG. 3, the regions "within the projections Q" means the cross-sectional regions A in the projections in FIG. 3, and are areas between two lines (line $X_1$ and line $X_2$ in FIG. 3) which each extend vertically toward the elastic layer 14 from two intersection points (intersection point $R_1$ and intersection point $R_2$ in FIG. 3) on the line L, which represents a position corresponding to the average thickness of the surface layer 16, from positions at which line L intersects with a line representing the outermost peripheral surface in the cross-sectional profile of the projections Q.

Ratio of Area occupied by Particles 16B Existing in Projections Q in Cross-Section of Projections Q The cross-sectional profile of the sample is observed to obtain the ratio of the areas of regions occupied by particles 16B existing in the cross-sectional regions A to the areas of the entire of the cross-sectional regions A, regarding the area of the entire of the cross-sectional regions A as 100%.

Specifically, the cross-section is observed, and ten projections Q are selected from plural projections Q. The area of the entire of each cross-sectional region A for each projection Q is determined by dividing each cross-sectional region A into portions and image-processing. Further, the area occupied by particles 16B in each cross-sectional region A for each projection Q is determined in the similar manner. The ratio of the area occupied by particles 16B within the cross-sectional region A to the area of the entire of the cross-sectional region A is calculated for each projection Q. The average value of the calculation results of the selected projections Q is calculated to turn out as 58%.

Count of Number of Particles 16B Existing in Recess P

Ten recesses P are arbitrarily selected from plural recesses P observed in the cross-sectional profile of the sample. The number of particles existing in these selected recesses P is counted. It is observed that the average number of the particles 16B existing in these recesses P is 4.

As shown in FIG. 3, the regions "within the recesses P" means the cross-sectional regions B in the recesses in FIG. 3, and are areas between two lines (line $X_i$ and line $X_2$ in FIG. 3) which each extend vertically toward the elastic layer 14 from two intersection points (intersection point $R_1$ and intersection point $R_2$ in FIG. 3) on the line L, which represents a position corresponding to the average thickness of the surface layer 16, from positions at which line L intersects with a line representing the outermost peripheral surface in the cross-sectional profile of the recesses P.

Ratio of Area Occupied by Particles 16B Existing in Recesses P in Cross-Section of Recesses P The cross-sectional profile of the sample is observed to obtain the ratio of the areas of regions occupied by particles 16B existing in the cross-sectional regions B to the areas of the entire of the cross-sectional regions B, regarding the area of the entire of the cross-sectional regions B as 100%.

Specifically, the cross-section is observed, and ten recesses P are selected from plural recesses P. The area of the entire of each cross-sectional region B for each recess P is determined by dividing each cross-sectional region B into portions and image-processing. Further, the area occupied by particles 16B in each cross-sectional region B for each recess P is determined in the similar manner. The ratio of the area occupied by particles 16B within the cross-sectional region B to the area of the entire of the cross-sectional region B is calculated for each recess P. The average value of the calculation results of the selected recesses P is calculated to turn out as 36%.

Durability Test

The electroconductive roll A1 prepared in Example 1 is subjected to a durability test to evaluate image quality and occurrence of cracking on the surface.

In the durability test, the electroconductive roll A1 prepared in Example 1 is incorporated into a process cartridge for DOCUCENTRE COLOR A450 (trade name, manufactured by Fuji Xerox Co., Ltd.) as a charging roll.

The bearings of the charging roll are supported by coil springs so as to apply a load of 600 g to each longitudinal end of the image holding body. The durability test is performed under the conditions of 10° C. and 15% RH, which are severe conditions of low temperature and low humidity which generally lead occurrence of cracking of the surface of the charging roll. Image patterns are continuously printed on A4 size recording paper with long edge feed at a halftone density of 30%.

The A4 size recording paper herein used has a basis weight of 200 g/m$^2$.

Evaluation of Image Quality

In the durability test, evaluations of image quality are performed for every 50,000 prints on A4 size sheets by examining whether longitudinal streaks attributed to the electroconductive roll (charging roll in Example 1) or density unevenness corresponding to the pitch of the charging roll arise. The evaluation of image quality is performed under the conditions of low temperature and low humidity (10° C. and 15% RH) where deterioration of image quality may take place significantly. Each sample for the evaluation of image quality is prepared to have an image having a solid halftone density of 30%, and is observed using X-RITE 404 (trade name, manufactured by X-Rite) to measure ΔD, which is the difference between an image density at the center of the image and an image density at longitudinal streaks (density unevenness).

The ΔD is evaluated in accordance with the following criteria. Smaller ΔD means higher density evenness of the surface of the image.

Evaluation Criteria

G0: $\Delta D \leqq 0.2$

G1: $0.2 < \Delta D \leqq 0.3$

G2: $\Delta D > 0.3$

G3: Plural density unevenness graded as G2 arise and density unevenness arises on the entire surface.

Evaluation of Occurrence of Cracking on Surface Layer

In the durability test, the surface of the electroconductive roll is observed for every 50,000 prints on A4 size sheets, and occurrence of cracking is evaluated. Specifically, cracks in regions with 1 mm in width for every 90° in the circumferential direction within the entire regions of the outer peripheral surface over one end to the other end in the axial direction of the surface of the electroconductive roll are observed by using a color 3D laser beam microscope ((trade name: VK8550; manufactured by Keyence Corporation), and further, the portions where cracks are formed are observed using an object lens of 50 magnifications, and the number of cracks is counted.

The number of cracks is counted in such a manner that a crack having a depth of 5 μm or more and a length of from 40 μm to 500 μm is counted as one, and the number of cracks having a length of 500 μm or more is counted up by one for every 500 μm (for example, the number of cracks of one crack having the length of 1,000 μm is "2"), and the number of cracks is defined as the sum of the counts. A crack having a depth of less than 5 μm is disregarded as a crack and is uncounted.

Example 2

In Example 1, the coating liquid for forming a surface layer is prepared in such a manner that as particles 16B, 35 parts by weight of nylon particles having an average particle diameter of 5 μm is added to 100 parts by weight of the solid content of the electroconductive liquid for forming a surface layer material. In Example 2, an electroconductive roll A2 is prepared in the same conditions and methods as those in Example 1, except that the addition amount of the nylon particles having an average particle diameter of 5 μm with respect to the 100 parts by weight of the solid content in the electroconductive liquid for forming a surface layer material is changed to 20 parts by weight.

The electroconductive roll A2 is subjected to measurements and evaluations in the same conditions and methods as those in Example 1. The results are shown in Tables 1A to 1C and Table 2.

Example 3

In Example 1, the coating liquid for forming a surface layer is prepared in such a manner that as particles 16B, 35 parts by weight of nylon particles having an average particle diameter of 5 μm is added to 100 parts by weight of the solid content of the electroconductive liquid for forming a surface layer material. In Example 3, an electroconductive roll A3 is prepared in the same conditions and methods as those in Example 1, except that the addition amount of the nylon particles having an average particle diameter of 5 μm with respect to the 100 parts by weight of the solid content in the electroconductive liquid for forming a surface layer material is changed to 50 parts by weight.

The electroconductive roll A3 is subjected to measurements and evaluations in the same conditions and methods as those in Example 1. The results are shown in Tables 1A to 1C and Table 2.

Example 4

In Example 1, the coating liquid for forming a surface layer is prepared in such a manner that as particles 16B, 35 parts by weight of nylon particles having an average particle diameter of 5 μm is added to 100 parts by weight of the solid content of the electroconductive liquid for forming a surface layer material. In Example 4, an electroconductive roll A4 is prepared in the same conditions and methods as those in Example 1, except that 20 parts by weight of nylon particles having an average particle diameter of 2 μm is added to the 100 parts by weight of the solid content in the electroconductive liquid for forming a surface layer material in place of the 35 parts by weight of nylon particles having an average particle diameter of 5 μm.

The electroconductive roll A4 is subjected to measurements and evaluations in the same conditions and methods as those in Example 1. The results are shown in Tables 1A to 1C and Table 2.

Example 5

In Example 1, the electroconductive roll A1 is incorporated into a process cartridge for DOCUCENTRE COLOR A450 (trade name, manufactured by Fuji Xerox Co., Ltd.) as a charging roll. In Example 5, the electroconductive roll A1 is incorporated into the process cartridge as a transfer roll thereof.

The electroconductive roll A1 of Example 5 is subjected to measurements and evaluations in the same conditions and methods as those in Example 1. The results are shown in Tables 1A to 1C and Table 2.

Example 6

An electroconductive roll A6 is prepared in the same conditions and methods as those in Example 1, except that the amount of methanol employed in the preparation of the surface layer is changed from 75 parts by weight to 67.5 parts by weight, the amount of n-butanol employed in the preparation of the surface layer is changed from 20 parts by weight to 18 parts by weight, and the amount of water employed in the preparation of the surface layer is changed from 5 parts by weight to 4.5 parts by weight.

The electroconductive roll A6 is subjected to measurements and evaluations in the same conditions and methods as those in Example 1. The results are shown in Tables 1A to 1C and Table 2.

Example 7

An electroconductive roll A7 is prepared in the same conditions and methods as those in Example 1, except that the amount of n-butanol employed in the preparation of the surface layer is reduced from 20 parts by weight to 5 parts by weight, and the amount of methanol employed in the preparation of the surface layer is increased from 75 parts by weight to 90 parts by weight, so that the content ratio of methanol is increased.

The electroconductive roll A7 is subjected to measurements and evaluations in the same conditions and methods as those in Example 1. The results are shown in Tables 1A to 1C and Table 2.

Example 8

An electroconductive roll A8 is prepared in the same conditions and methods as those in Example 1, except that the drying temperature is raised from room temperature (22° C.) to 110° C.

The electroconductive roll A8 is subjected to measurements and evaluations in the same conditions and methods as those in Example 1. The results are shown in Tables 1A to 1C and Table 2.

Comparative Example 1

In Example 1, the coating liquid for forming a surface layer is prepared in such a manner that as particles 16B, 35 parts by weight of nylon particles having an average particle diameter of 5 μm is added to 100 parts by weight of the solid content of the electroconductive liquid for forming a surface layer material. In Comparative example 1, an electroconductive roll B1 is prepared in the same conditions and methods as those in Example 1, except that 35 parts by weight of nylon particles having an average particle diameter of 15 μm is added to the 100 parts by weight of the solid content in the electroconductive liquid for forming a surface layer material in place of the 35 parts by weight of nylon particles having an average particle diameter of 5 μm.

The electroconductive roll B1 is subjected to measurements and evaluations in the same conditions and methods as those in Example 1. The results are shown in Tables 1A to 1C and Table 2.

Comparative Example 2

In Example 1, the coating liquid for forming a surface layer is prepared in such a manner that as particles 16B, 35 parts by weight of nylon particles having an average particle diameter of 5 μm is added to 100 parts by weight of the solid content of the electroconductive liquid for forming a surface layer material. In Comparative example 2, an electroconductive roll B2 is prepared in the same conditions and methods as those in Example 1, except that no particle 16B (no nylon particle) is added to the electroconductive liquid for forming a surface layer material.

The electroconductive roll B2 is subjected to measurements and evaluations in the same conditions and methods as those in Example 1. The results are shown in Tables 1A to 1C and Table 2.

Comparative Example 3

An electroconductive roll B3 is prepared in the same conditions and methods as those in Example 1, except that 10 parts by weight of butyral resin is added to the electroconductive liquid for forming a surface layer material as a dispersion stabilizer.

The electroconductive roll B3 is subjected to measurements and evaluations in the same conditions and methods as those in Example 1. The results are shown in Tables 1A to 1C and Table 2.

Comparative Example 4

In Example 1, the coating liquid for forming a surface layer is prepared in such a manner that as particles 16B, 35 parts by weight of nylon particles having an average particle diameter of 5 μm is added to 100 parts by weight of the solid content of the electroconductive liquid for forming a surface layer material. In Comparative example 4, an electroconductive roll B4 is prepared in the same conditions and methods as those in Example 1, except that 35 parts by weight of nylon particles having an average particle diameter of 20 μm is added to the 100 parts by weight of the solid content in the electroconductive liquid for forming a surface layer material in place of the 35 parts by weight of nylon particles having an average particle diameter of 5 μm.

The electroconductive roll B4 is subjected to measurements and evaluations in the same conditions and methods as those in Example 1. The results are shown in Tables 1A to 1C and Table 2.

TABLE 1A

| | | | Example 1 | Example 2 | Example 3 | Example 4 |
|---|---|---|---|---|---|---|
| Electroconductive roll | | | A1 | A2 | A3 | A4 |
| Coating liquid for forming Surface layer | Resin material 16A | Name | FINE RESIN ® FR101 | FINE RESIN ® FR101 | FINE RESIN ® FR101 | FINE RESIN ® FR101 |
| | | Addition amount (parts by weight) | 100 | 100 | 100 | 100 |
| | Methanol (parts by weight) | | 75 | 75 | 75 | 75 |
| | Butanol (parts by weight) | | 20 | 20 | 20 | 20 |
| | Water (parts by weight) | | 5 | 5 | 5 | 5 |
| | Citric acid (parts by weight) | | 0.3 | 0.3 | 0.3 | 0.3 |
| | Carbon black (parts by weight) | | 20 | 20 | 20 | 20 |
| | Butyral (parts by weight) | | — | — | — | — |
| | Particle 16B | Average particle diameter (μm) | 5 | 5 | 5 | 2 |
| | | Addition amount (parts by weight) | 35 | 20 | 50 | 20 |
| | Viscosity (Pa · s) | | 35 | 31 | 36 | 33 |
| Average thickness of Surface layer 16 (μm) | | | 9 | 9 | 8 | 9 |
| Time for drying Coating layer 17 [(min.)/baking time (min.)] | | | 1/20 | 1/20 | 1/20 | 1/20 |
| Drying temperature (° C.) | | | 22 | 22 | 22 | 22 |
| Rz of Surface layer 16 (μm) | | | 7 | 4.2 | 12 | 3.8 |
| Number of Particles 16B existing in Projection Q | | | 11 | 6 | 15 | 13 |

TABLE 1A-continued

| | Example 1 | Example 2 | Example 3 | Example 4 |
|---|---|---|---|---|
| Ratio of Area occupied by particles 16B existing in Projections Q (%) | 58 | 31 | 78 | 28 |
| Number of Particles 16B existing in Recess P | 4 | 3 | 4 | 6 |
| Ratio of Area occupied by Particles 16B existing in Recesses P (%) | 36 | 28 | 33 | 31 |

TABLE 1B

| | | | Example 5 | Example 6 | Example 7 | Example 8 |
|---|---|---|---|---|---|---|
| Electroconductive roll | | | A1 | A6 | A7 | A8 |
| Coating liquid for forming Surface layer | Resin material 16A | Name | FINE RESIN ® FR101 | FINE RESIN ® FR101 | FINE RESIN ® FR101 | FINE RESIN ® FR101 |
| | | Addition amount (parts by weight) | 100 | 100 | 100 | 100 |
| | Methanol (parts by weight) | | 75 | 67.5 | 90 | 75 |
| | Butanol (parts by weight) | | 20 | 18 | 5 | 20 |
| | Water (parts by weight) | | 5 | 4.5 | 5 | 5 |
| | Citric acid (parts by weight) | | 0.3 | 0.3 | 0.3 | 0.3 |
| | Carbon black (parts by weight) | | 20 | 20 | 20 | 20 |
| | Butyral (parts by weight) | | — | — | — | — |
| | Particle 16B | Average particle diameter (μm) | 5 | 5 | 5 | 5 |
| | | Addition amount (parts by weight) | 35 | 35 | 35 | 35 |
| | Viscosity (Pa · s) | | 35 | 39 | 35 | 35 |
| Average thickness of Surface layer 16 (μm) | | | 9 | 9 | 9 | 9 |
| Time for drying Coating layer 17 [(min.)/baking time (min.)] | | | 1/20 | 1/20 | 1/20 | 1/20 |
| Drying temperature (° C.) | | | 22 | 22 | 22 | 110 |
| Rz of Surface layer 16 (μm) | | | 7 | 6.1 | 8.1 | 7.8 |
| Number of Particles 16B existing in Projection Q | | | 11 | 13 | 14 | 12 |
| Ratio of Area occupied by particles 16B existing in Projections Q (%) | | | 58 | 52 | 68 | 64 |
| Number of Particles 16B existing in Recess P | | | 6 | 4 | 4 | 5 |
| Ratio of Area occupied by Particles 16B existing in Recesses P (%) | | | 53 | 37 | 35 | 44 |

TABLE 1C

| | | | Comp. example 1 | Comp. example 2 | Comp. example 3 | Comp. example 4 |
|---|---|---|---|---|---|---|
| Electroconductive roll | | | B1 | B2 | B3 | B4 |
| Coating liquid for forming Surface layer | Resin material 16A | Name | FINE RESIN ® FR101 | FINE RESIN ® FR101 | FINE RESIN ® FR101 | FINE RESIN ® FR101 |
| | | Addition amount (parts by weight) | 100 | 100 | 100 | 100 |
| | Methanol (parts by weight) | | 75 | 75 | 75 | 75 |
| | Butanol (parts by weight) | | 20 | 20 | 20 | 20 |
| | Water (parts by weight) | | 5 | 5 | 5 | 5 |
| | Citric acid (parts by weight) | | 0.3 | 0.3 | 0.3 | 0.3 |
| | Carbon black (parts by weight) | | 20 | 20 | 20 | 20 |
| | Butyral (parts by weight) | | — | — | 10 | — |
| | Particle 16B | Average particle diameter (μm) | 15 | None | 5 | 20 |
| | | Addition amount (parts by weight) | 35 | | 35 | 35 |
| | Viscosity (Pa · s) | | 34 | 36 | 33 | 34 |
| Average thickness of Surface layer 16 (μm) | | | 10 | 9 | 9 | 11 |
| Time for drying Coating layer 17 [(min.)/baking time (min.)] | | | 1/20 | 1/20 | 1/20 | 1/20 |
| Drying temperature (° C.) | | | 22 | 22 | 22 | 22 |
| Rz of Surface layer 16 (μm) | | | 13 | 2.4 | 4 | 18 |
| Number of Particles 16B existing in Projection Q | | | 1 | — | 6 | 1 |

TABLE 1C-continued

| | Comp. example 1 | Comp. example 2 | Comp. example 3 | Comp. example 4 |
|---|---|---|---|---|
| Area coverage ratio by particles 16B in Projection Q (%) | 81 | — | 25 | 80 |
| Number of Particles 16B existing in Recess P | 0 | — | 6 | 0 |
| Area coverage ratio by particles 16B in Recess P (%) | 0 | — | 52 | 0 |

In Tables 1A to 1C, the "area coverage ratio by particles 168 in projection Q" means the ratio of the areas of regions occupied by particles 16B existing in the cross-sectional regions of the projections Q to the areas of the entire of the cross-sectional regions of the projections Q, and the "area coverage ratio by particles 16B in recess P" means the ratio of the areas of regions occupied by particles 16B existing in the cross-sectional regions of the recesses P to the areas of the entire of the cross-sectional regions of the recesses P.

TABLE 2

| | | Number of sheet printed at Timing for Evaluation | | | |
|---|---|---|---|---|---|
| | | 50,000 | 100,000 | 150,000 | 200,000 |
| Example 1 | Image quality | G0 | G0 | G0 | G0 |
| | Number of Crack | None | None | None | None |
| Example 2 | Image quality | G0 | G0 | G0 | G0 |
| | Number of Crack | None | None | None | None |
| Example 3 | Image quality | G0 | G0 | G0 | G0 |
| | Number of Crack | None | None | None | None |
| Example 4 | Image quality | G0 | G0 | G0 | G0 |
| | Number of Crack | None | None | None | None |
| Example 5 | Image quality | G0 | G0 | G0 | G0 |
| | Number of Crack | None | None | None | None |
| Example 6 | Image quality | G0 | G0 | G0 | G0 |
| | Number of Crack | None | None | None | None |
| Example 7 | Image quality | G0 | G0 | G0 | G0 |
| | Number of Crack | None | None | None | None |
| Example 8 | Image quality | G0 | G0 | G0 | G0 |
| | Number of Crack | None | None | None | None |
| Comparative example 1 | Image quality | G0 | G0 | G0 | G0 |
| | Number of Crack | None | None | 1 | 6 |
| Comparative example 2 | Image quality | G0 | G2 | G3 | — |
| | Number of Crack | None | None | None | None |
| Comparative example 3 | Image quality | G0 | G1 | G2 | — |
| | Number of Crack | None | None | 80 | — |
| Comparative example 4 | Image quality | G2 | — | — | — |
| | Number of Crack | Numerous | — | — | — |

The electroconductive roll B1, that is used as a charging roll in Comparative example 1, contains the particle 16B in its surface layer, but the number of particle existing in the projections Q is only one. Comparative example 1 does not cause deterioration in image quality, but one crack on the surface of the electroconductive roll B1 is observed when printing on the 150,000th sheet is finished, and six cracks on the surface of the electroconductive roll B1 are observed when printing on the 200,000th sheet is finished.

The electroconductive roll B2, that is used as a charging roll in Comparative example 2, contains no particle 16B in its surface layer. When printing on the 50,000th sheet is finished, white turbidity due to adhesion of toner components is observed on the surface of the electroconductive roll B2, although it does not cause deterioration in image quality. When printing on the 100,000th sheet is finished, deterioration in image quality in which streaks arise in the conveyance direction of recording sheet is observed. This deterioration in image quality may be resulted from adhesion of toner components onto the uppermost surface of the charging roll (the electroconductive roll B2). Further, when printing on the 200,000th sheet is finished, uneven charging arises in the surface layer to make evaluation of the image quality and the number of cracks be impossible.

The electroconductive roll B3, that is used as a charging roll in Comparative example 3, contains the particle 16B in its surface layer, but the area coverage ratio by particles 16B in projection Q is smaller than the area coverage ratio by particles 16B in recess P. When printing on the 50,000th sheet is finished, the electroconductive roll B3, no stain and no crack on the surface of the charging roll as a electroconductive roll 133 is observed. However, when printing on the 100,000th sheet is finished, deterioration in image quality in which streaks slightly arise is observed. When printing on the 150,000th sheet is finished, the number of cracks in the surface layer and the width of the cracks become larger, and deterioration in image quality arises in accordance with the increase in the number of the cracks. When printing on the 200,000th sheet is finished, uneven charging arises in the surface layer to make evaluation of the image quality and the number of cracks be impossible.

The electroconductive roll B4, that is used as a charging roll in Comparative example 4, contains the particle 16B in its surface layer, but the number of particle existing in the projections Q is only one. Removal of particles 16B from the surface of the electroconductive roll B4 is observed and numerous and innumerable cracks are produced before the printing on the 50,000th sheet is finished. When printing on the 100,000th- or more sheet is finished, uneven charging arises in the surface layer to make evaluation of the image quality and the number of cracks be impossible.

On the other hand, in Example 1, although stains on the surface of the electroconductive roll A1 used as a charging roll are visually observed, good image quality is maintained without causing deterioration of image quality until when printing on the 200,000th sheet is finished. Further, occurrence of cracking is not observed and it may be said that the longer operating life of an electroconductive roll is achievable.

Further, deterioration of image quality and cracks on the surface of the electroconductive roll are hardly produced in Example 1 to Example 8, as compared with Comparative examples. While stains on the electroconductive rolls are visually observed in any of Examples 1 to 8, deterioration of image quality hardly arises and good image quality is maintained until when printing on the 200,000th sheet is finished.

Form the results in the above, when the electroconductive rolls prepared in the Examples are used as a charging roll or a transfer roll, occurrence of cracking on the outer peripheral surface may be suppressed, and stable image quality may be maintained over a long period of time as compared with the electroconductive rolls prepared in Comparative examples. Further, when the electroconductive rolls prepared in Examples are used as a charging roll or a transfer roll, adhesion or deposition of foreign matter such as toner or the like to the outer peripheral surface may be suppressed, and a longer operating life of the electroconductive roll may be attained as compared with the electroconductive rolls prepared in Comparative examples.

The foregoing description of the exemplary embodiments of the invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electroconductive roll having at least a surface layer forming an outer peripheral surface of the electroconductive roll, the surface layer comprising projections and recesses, the projections comprising a plurality of particles, and a ratio of an area occupied by particles existing in a cross-section of a projection to an entire area of the cross-section of the projection being larger than a ratio of an area occupied by particles existing in a cross-section of a recess to an entire area of the cross-section of the recess.

2. The electroconductive roll of claim 1, wherein the ratio of the area occupied by particles existing in the cross-section of the projection to the entire area of the cross-section of the projection is in a range of from approximately 20% to approximately 80%.

3. The electroconductive roll of claim 1, wherein the ratio of the area occupied by particles existing in the cross-section of the projection to the entire area of the cross-section of the projection is in a range of from approximately 30% to approximately 70%.

4. The electroconductive roll of claim 1, wherein the ratio of the area occupied by particles existing in the cross-section of the projection to the entire area of the cross-section of the projection is in a range of from approximately 30% to approximately 50%.

5. The electroconductive roll of claim 1, wherein a ten-point average roughness Rz of the outer peripheral surface of the surface layer is in a range of from approximately 4 μm to approximately 20 μm.

6. The electroconductive roll of claim 1, further comprising a core body and an elastic layer, the elastic layer being provided on or above an outer peripheral surface of the core body, and the surface layer being provided on or above an outer peripheral surface of the elastic layer.

7. The electroconductive roll of claim 1, wherein an average particle diameter of the particles is in a range of from approximately 2 μm to approximately 15 μm.

8. A method of producing the electroconductive roll of claim 1, the method comprising applying, on or above the outer peripheral surface of the elastic layer, a coating liquid comprising the particles and a resin material, such that the projections and recesses are formed as a result of distances between the particles changing due to the particles being displaced in accordance with a convection that occurs in the coating liquid when the coating liquid is applied on or above the outer peripheral surface.

9. A charging device comprising the electroconductive roll of claim 1.

10. The charging device of claim 9, wherein the ratio of the area occupied by particles existing in the cross-section of the projection to the entire area of the cross-section of the projection is in a range of from approximately 20% to approximately 80%.

11. The charging device of claim 9, wherein the ratio of the area occupied by particles existing in the cross-section of the projection to the entire area of the cross-section of the projection is in a range of from approximately 30% to approximately 70%.

12. The charging device of claim 9, wherein the ratio of the area occupied by particles existing in the cross-section of the projection to the entire area of the cross-section of the projection is in a range of from approximately 30% to approximately 50%.

13. The charging device of claim 9, wherein a ten-point average roughness Rz of the outer peripheral surface of the surface layer is in a range of from approximately 4 μm to approximately 20 μm.

14. The charging device of claim 9, wherein the electroconductive roll further comprises a core and an elastic layer, the elastic layer being provided on or above an outer peripheral surface of the core, and the surface layer being provided on or above an outer peripheral surface of the elastic layer.

15. The charging device of claim 9, wherein an average particle diameter of the particles is in a range of from approximately 2 μm to approximately 15 μm.

16. A process cartridge comprising:

an image holding member; and at least one of a charging roll that charges a surface of the image holding member and that is the electroconductive roll of claim 1 or a transfer roll that transfers, onto a recording medium, a toner image formed on the surface of the image holding member, and that is the electroconductive roll of claim 1.

17. An image forming apparatus comprising:

an image holding member;

a charging unit that charges a surface of the image holding member;

a latent image forming unit that forms a latent image on a surface of the image holding member that has been charged by the charging unit;

a developing unit that develops the latent image formed on the surface of the image holding member into a toner image; and a transfer unit that transfers the toner image onto a recording medium, and at least one of the charging unit or the transfer unit comprising the electroconductive roll of claim 1.

* * * * *